US012577870B2

(12) United States Patent
Rahimi-Aghdam et al.

(10) Patent No.: US 12,577,870 B2
(45) Date of Patent: Mar. 17, 2026

(54) FORMATION FRACTURE CHARACTERIZATION FROM POST SHUT-IN ACOUSTICS AND PRESSURE DECAY USING A 3 SEGMENT MODEL

(71) Applicant: Seismos, Inc., Austin, TX (US)

(72) Inventors: Saeed Rahimi-Aghdam, Chicago, IL (US); Ibrahim Said Abou-Sayed, Sugar Land, TX (US); Daniel Moos, Palo Alto, CA (US); David Murray, Austin, TX (US)

(73) Assignee: Seismos, Inc., Austin, TX (US)

( * ) Notice: Subject to any disclaimer, the term of this patent is extended or adjusted under 35 U.S.C. 154(b) by 379 days.

(21) Appl. No.: 18/239,641

(22) Filed: Aug. 29, 2023

(65) Prior Publication Data

US 2023/0399940 A1 Dec. 14, 2023

Related U.S. Application Data

(63) Continuation of application No. PCT/US2022/020455, filed on Mar. 15, 2022.

(Continued)

(51) Int. Cl.

| | |
|---|---|
| ***E21B 47/06*** | (2012.01) |
| ***E21B 43/267*** | (2006.01) |
| ***E21B 49/00*** | (2006.01) |

(52) U.S. Cl.

CPC ..... *E21B 47/06* (2013.01); *E21B 43/267* (2013.01); *E21B 49/008* (2013.01); *E21B 2200/20* (2020.05)

(58) Field of Classification Search

CPC ..... E21B 43/267; E21B 47/06; E21B 49/008; E21B 2200/20

See application file for complete search history.

(56) References Cited

U.S. PATENT DOCUMENTS 4,398,416 A * 8/1983 Nolte ..... E21B 43/26 166/250.1
5,050,674 A * 9/1991 Soliman ..... E21B 43/26 166/308.1

(Continued)

FOREIGN PATENT DOCUMENTS

CA 2624304 C * 12/2011 ..... E21B 49/008
CA 3205295 A1 * 7/2022 ..... E21B 43/11

OTHER PUBLICATIONS

Chuprakov et al. "Continued hydraulic fracture growth after well shut-in" American Rock Mechanics Association, ARMA 17-144 (Year: 2017).*

(Continued)

*Primary Examiner* — John Fitzgerald
(74) *Attorney, Agent, or Firm* — Richard A. Fagin

(57) ABSTRACT

A method for determining properties of hydraulic fractures from measurements of pressure in a well made after stopping pumping fracturing fluid into the well (shut in) includes determining a first time after shut in whereinafter a decrease in measured pressure is caused by fluid leak off in a fracture. A second time after shut in is determined whereinafter the decrease in pressure is caused by fluid leak off, fracture growth and fluid pressure equilibration in the fracture. A third time after shut in is determined whereinafter the decrease in pressure is caused by fluid leak off, fracture growth, fluid pressure equilibration in the fracture and pressure drop in a near wellbore zone. Values of fluid efficiency, minimum stress and net pressure which are determined result in a calculated pressure with respect to time matching the pressure measurements within a predetermined threshold.

32 Claims, 23 Drawing Sheets

Related U.S. Application Data

(60) Provisional application No. 63/161,361, filed on Mar. 15, 2021.

(56) References Cited

U.S. PATENT DOCUMENTS

| | | | | |
|---|---|---|---|---|
| 5,105,659 | A * | 4/1992 | Ayoub | E21B 43/26 166/250.09 |
| 6,076,046 | A * | 6/2000 | Vasudevan | E21B 43/267 166/250.08 |
| 6,705,398 | B2 * | 3/2004 | Weng | E21B 49/008 166/250.1 |
| 7,272,973 | B2 * | 9/2007 | Craig | E21B 49/008 73/861 |
| 7,389,185 | B2 * | 6/2008 | Craig | E21B 49/008 702/13 |
| 10,544,667 | B2 * | 1/2020 | Wu | E21B 43/267 |
| 10,753,181 | B2 * | 8/2020 | Roussel | E21B 49/00 |
| 10,995,609 | B2 * | 5/2021 | Felkl | E21B 49/008 |
| 11,459,884 | B2 * | 10/2022 | Alruwaili | E21B 49/006 |
| 11,608,740 | B2 * | 3/2023 | Moos | E21B 43/00 |
| 11,913,330 | B2 * | 2/2024 | Moos | E21B 49/006 |
| RE50,021 | E * | 6/2024 | Felkl | E21B 47/06 |
| 12,378,863 | B1 * | 8/2025 | Yang | E21B 43/26 |
| RE50,568 | E * | 9/2025 | Felkl | E21B 47/06 |
| 2006/0219402 | A1 | 10/2006 | Lecampion | |
| 2008/0066909 | A1 | 3/2008 | Hutchins et al. | |
| 2014/0262232 | A1 | 9/2014 | Dusterhoft et al. | |
| 2016/0108705 | A1 | 4/2016 | Maxwell et al. | |
| 2019/0310386 | A1 | 10/2019 | Quan et al. | |

OTHER PUBLICATIONS

International Search Report and Written Opinion, International Application No. PCT/US2022/020455 dated Jun. 15, 2022.

* cited by examiner

A

| Fluid | BHT ($F^o/C^o$) | Fluid Degradation | $\beta_s$ |
|---|---|---|---|
| Linear Gel | 80/27 | 1 | 0.64 |
| | 150/65 | 2 | 0.56 |
| Crosslink Gel | 140/60 | 0 | 0.76 |
| | 200/95 | 1 | 0.64 |
| | 260/125 | 2 | 0.56 |
| Nitrogen Foam | 100/38 | 1 | 0.64 |
| | 160/70 | 2 | 0.54 |
| Gelled Oil | 120/50 | 1 | 0.62 |
| | 180/80 | 2 | 0.55 |

B

B

A

B

A

FORMATION FRACTURE CHARACTERIZATION FROM POST SHUT-IN ACOUSTICS AND PRESSURE DECAY USING A 3 SEGMENT MODEL

CROSS REFERENCE TO RELATED APPLICATIONS

Continuation of International Application No. PCT/US2022/020455 filed Mar. 15, 2022. Priority is claimed from U.S. Provisional Application No. 63/161,361 filed on Mar. 15, 2021. Both the foregoing applications are incorporated herein by reference in their entirety.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable

BACKGROUND

Pressure decay analysis is sometimes used to analyze hydraulic fractures in subsurface formations penetrated by a well. Pressure decay analysis captures pressure data over a time period following fluid injection into a formation. This fluid injection can be hydraulic fracturing where proppant is injected to maintain fracture opening to allow for a subsequent enhanced hydrocarbon production. Several models and approaches are known in the art. This invention improves significantly on state of the art by considering the separate contribution of near-wellbore region to pressure decay and constraining the fracture and pressure decay model with direct acoustic measurements of near wellbore conductivity. This allows for a more accurate determination of the fracture system and its properties.

SUMMARY

A method according to one aspect of the present disclosure for determining properties of hydraulic fractures from measurements of pressure in a well made after stopping pumping fracturing fluid into the well (shut in) includes determining a first time after shut in where after a decrease in measured pressure is caused by fluid leak off in a fracture. A second time after shut in is determined where after the decrease in pressure is caused by fluid leak off, fracture growth and fluid pressure equilibration in the fracture. A third time after shut in is determined where after the decrease in pressure is caused by fluid leak off, fracture growth, fluid pressure equilibration in the fracture and pressure drop in a near wellbore zone. Values of fluid efficiency, minimum stress and net pressure which are determined result in a calculated pressure with respect to time matching the pressure measurements within a predetermined threshold. Calculating pressure with respect to time is based on causes of pressure drop in segments corresponding to time between (i) the third time and the second time, (ii) the second time and the first time, and (iii) after the first time.

A computer program according to another aspect of this disclosure is stored in a non-transitory computer readable medium and comprises logic operable to cause the computer to perform actions corresponding to the method of the previous aspect of the disclosure.

In some embodiments, the calculated pressure beginning at the first time comprises calculating Carter leak off.

In some embodiments, the calculated pressure beginning at the second time and ending at the third time comprises calculating $$p_{av} = S_{min} + p^* + \left(\overline{p_n}^0 - p^*\right)\sqrt{\frac{1-\xi_f}{\xi_f}}\, tg\left[\arctan\left(\sqrt{\frac{\xi_f}{1-\xi_f}}\right) - \frac{t}{t_{inj}}\frac{\overline{p_n}^0}{\overline{p_n}^0 - p^*}\frac{\sqrt{\xi_f(1-\xi_f)}}{\eta_{av}}\right]$$

in which $\xi_f$=Local efficiency or fracture growth ratio at shut-in, $\eta_{av}$=Average efficiency from start of fluid pumping to shut in, $p_{av}$=average net pressure in the fracture, p*=fracture propagation pressure, $\overline{p}_n$=average net pressure, $p_n^0$=initial net pressure $t_{inj}$=injection time, t=time for which pressure calculation is made, and Smin—minimum principal stress.

In some embodiments, the calculated pressure beginning at the third time and ending at the second time comprises calculating Darcy equation flow for an axisymmetric, bi-wing fracture having cylindrical cross-sectional growth.

In some embodiments, the calculated pressure beginning at the third time and ending at the second time comprises analyzing reflections in measurements of pressure or pressure time derivative in response to acoustic pulses emitted into the well to calculate a near field conductivity index. The acoustic pulses induce tube waves in the well. The near field conductivity index is used to constrain calculations of near wellbore pressure drop.

Some embodiments further comprise using the determined values of fluid efficiency, minimum stress and net pressure, and using values of Young's modulus, Poisson's ratio, viscosity of the fracturing fluid, pumped volume of the fracturing fluid, a volume rate of pumping the fracturing fluid, a number of well perforation clusters through which the fracturing fluid is pumped, determining a length, a width, a height and a leak off parameter of the fracture.

In some embodiments, the determined length, width, height and leak off parameter are used to estimate a fluid productivity of a fracture treatment stage in the well and the entire well.

In some embodiments, the determining length, width and height of the fracture comprises using a Perkins-Kern-Nordgren model of geometry of the fracture.

In some embodiments, the third time occurs after an end of water hammer induced by the stopping pumping.

In some embodiments, the second time is determined when a rate of change of the measurements of pressure with respect to time fall below a predetermined threshold.

In some embodiments, the first time is determined when the measurements of pressure fall below a fracturing pressure of a rock formation into which the fracturing fluid is pumped.

Some embodiments further comprise estimating a fluid pressure in a formation penetrated by the fracture using the determined minimum stress.

In some embodiments, the efficiency comprises a fraction of a volume of the fracture with respect to a volume of fracturing fluid pumped into the fracture.

Some embodiments further comprise determining fracture conductivity with respect to time after shut in.

Some embodiments further comprise determining a proppant packed conductivity when the fracture conductivity stops changing with respect to time after shut in.

Some embodiments further comprise changing at least one of viscosity of the fracturing fluid, pumped volume of the fracturing fluid, a volume rate of pumping the fracturing fluid, a concentration of proppant in the fracturing fluid for pumping fracture fluid into a different stage in the well or in a different well.

Other aspects of the present disclosure and possible advantages will be apparent from the description and claims that follow.

BRIEF DESCRIPTION OF THE DRAWINGS

FIG. 1B shows fluid flow into a fracture during hydraulic fracture pumping and during shut-in.

DEFINITIONS USED IN THE FOLLOWING DESCRIPTION

The following is an alphabetical list of names, symbols and abbreviations used in the detailed description below:

A Surface Area (for elliptical shape $A=\pi Hw/4$)
$E'=E/(1-v)$
E=Young modulus
$f_T$ Total friction
$f_{pipe}$=Pipe friction
$f_{perf}$=Perforation friction
H=Fracture Height
k=Permeability (For elliptical cross section $k=w^2/16$)
L=Fracture length
$N_{clust}$=Number of well casing or liner perforation clusters per stage
$Q_{inj}$=Average injected volume rate
$q_T$=Total volume rate entering the fracture
$q_l$=Leak-off volume rate
$q_{fg}$=Water loss due to fracture growth and natural fractures
$q_{fc}$=Volume rate associated with fracture compressibility
$q_{NWB}$=Volume rate from NWB to FF zone
q=Fluid volume rate in the fracture
$\xi_f$=Local efficiency or fracture growth ratio at the shut-in time ($n_f=q_f g/q_T$)
$\eta_{av}$=Average efficiency from start of pumping to shut in ($\eta_{av}=V_{fr}/V_{inj}$)
$p_M$=Net pressure in the mouth of fracture
$p_w$=Pressure in wellbore and next to fracture
$p_{ave}$=Average net pressure in the fracture
$p_n$=Net pressure
$\overline{p_n}$=Average net pressure
$p_n^M$=Net pressure in the mouth of the fracture
$p_{tip}$=Pressure at the tip of the fracture
$p_{NWBPL}$=Near-wellbore pressure loss
p*=Fracture propagation pressure (below this pressure we no fracture growth)
$p_n^0$=Initial net pressure (assuming infinite permeability)
$p_f$=Total pressure in the fracture (assuming infinite permeability)
$\beta s=(\overline{p_n})/(p_n^M)$
$t_{inj}$=Injection time (pumping stage)
t=Decay time (calculated from shut-in)
$S_{min}$=Minimum principal stress
μ=Fluid viscosity
v=Poisson ratio
β=Compressibility
$t_{mat}$=The time that pressure-fit curve matched the pressure data points
$u_{leak}$=leak-off rate per unit length
$V_{fr}$=Volume of fracture (volume that proppant has permeated to: main fracture and big natural fractures)
$V_{inj}$=Injected fluid volume ($V_{inj}=Q_{inj}t_{inj}$)
w=Fracture width (For fractures where l>>H,w=(2H/E')$p_n$)
NFCI=Near Field Connectivity (conductivity) Index

DETAILED DESCRIPTION

This disclosure relates to determination of fracture properties, such as fracture length, width, height, fracture conductivity, formation fluid (pore) pressure, and reservoir/ completion quality. Input data used in the determination may be obtained from the available data measured during pumping a hydraulic fracture stage such as fracture fluid injection rate, injection volume, fracturing fluid composition, etc. Additional data may include a measured pressure after the end of fracture pumping, which pressure decays after shut-in (after the end of fracture fluid pumping).

Figure 1A:
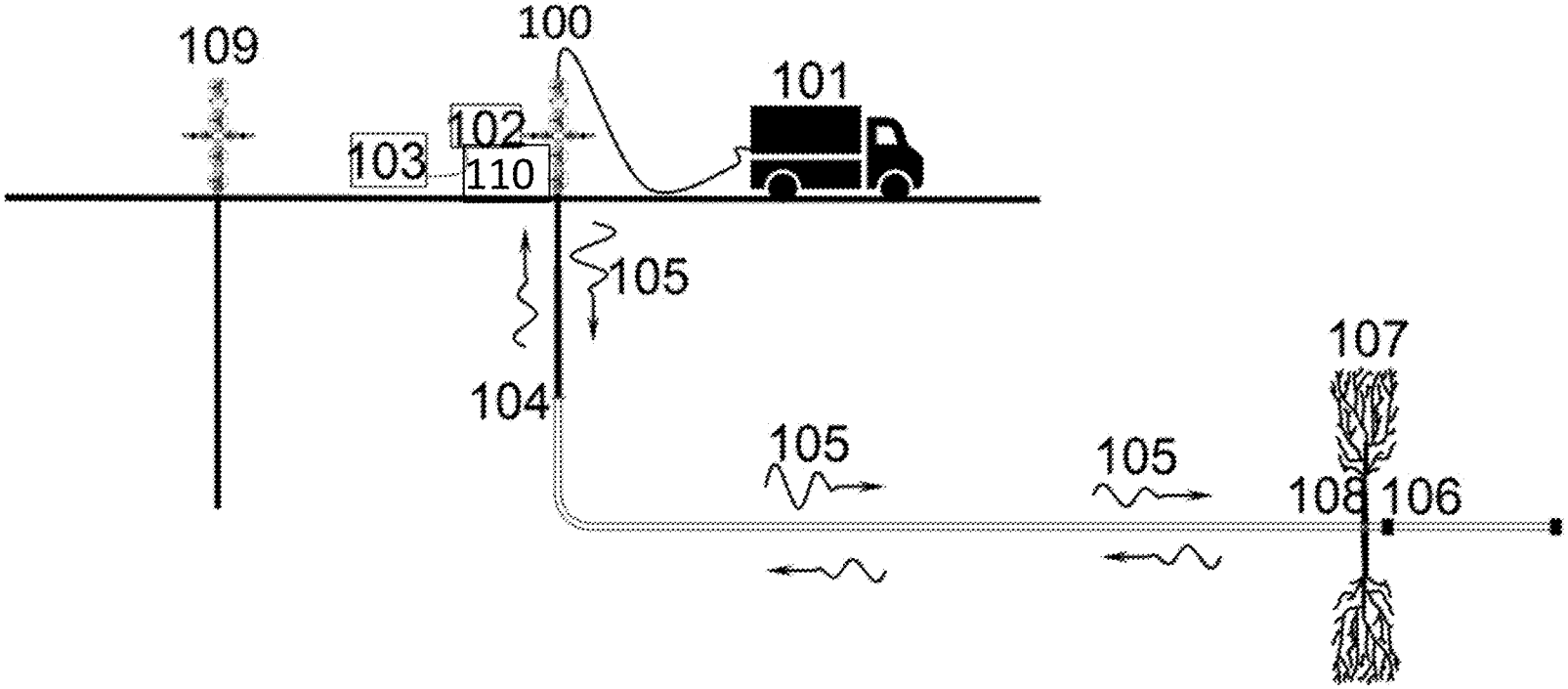
FIG. 1A shows an example embodiment of data acquisition and recording to be used in connection with a method according to the present disclosure.

FIG. 1A is a schematic diagram of an example well data acquisition system that may be used in some embodiments. The system 100 comprises components associated with a well including fluid pump(s) 101, sensors such as hydrophones or pressure transducers 102, a data acquisition and processing apparatus 103, a cased or open well 104, plug or wellbore bottom 106, fracture network 107, and perforations 108. A nearby well 109 (vertical or horizontal) may be present in the area of interest. A water hammer pulse 105 may be generated either by the pumps 101 such as by a change in the rate of pumping, or a pressure pulse may be generated by other means, for example a pressure pulse generator 110. Some pressure pulses are the ones generated inherently as part of fluid pumping. Such pulses could be considered "passive" and generally preferred measurement as no additional pressure pulse source is necessary. The pressure pulse(s) will travel and reflect along the well. Nonintrusive sensors, such as pressure transducers, accelerometers, and hydrophone(s), may be disposed in a location on or near the top of the well (e.g., the wellhead) to measure pressure, pressure time derivative and/or particle motion data continuously before, during, and after pumping of a fracture treatment stage. Similar measurements may be made at other points along the well and surface equipment where pressure pulses or pumping noise are detectable.

Figure 1B:
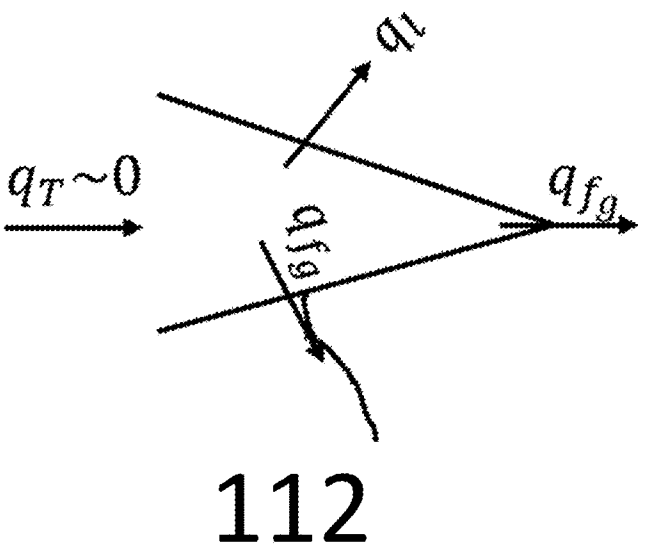
Figure 1B:
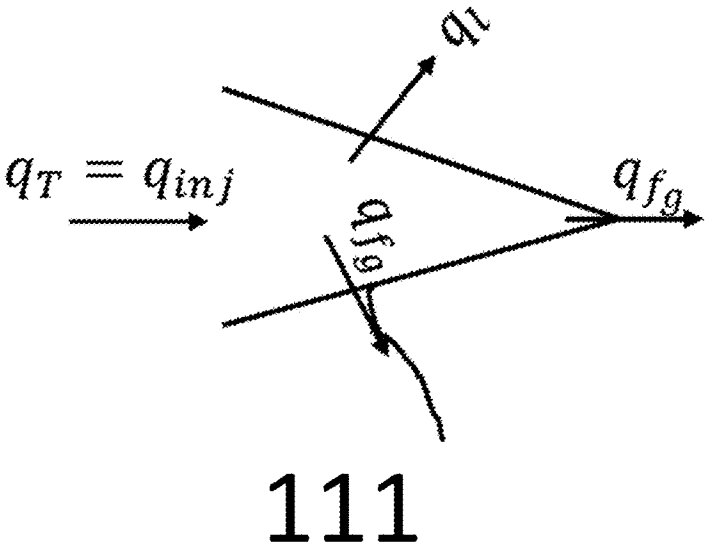

FIG. 1B graphically depicts typical fluid flow (generally named "q" with various subscripts) during, at 111, and after, at 112 pumping a hydraulic fracturing treatment or, more generally, any fluid being injected into a subsurface fracture system. During injection, the flow rate $q_{inj}=q_T>0$. After injection stops, $q_{inj}=0$ and $q_T\sim 0$ (no fluid enters the fracture, fluid only leaks off).

Signals, such as pressure (p) and pressure time derivative (dp/dt) may be recorded in this example and may be processed as explained in more detail below. Pressure pulses may induce tube waves in the well; pressure or pressure time derivative signals may be processed to extract usable resonances and other events to detect anomalies in the fracture-wellbore system. In particular, some pulses and their reflections can be used to determine near-field, or near-wellbore (NWB) connectivity index (NFCI) according to U.S. Pat. No. 10,641,090 issued to Felkl et al.

Figure 2:
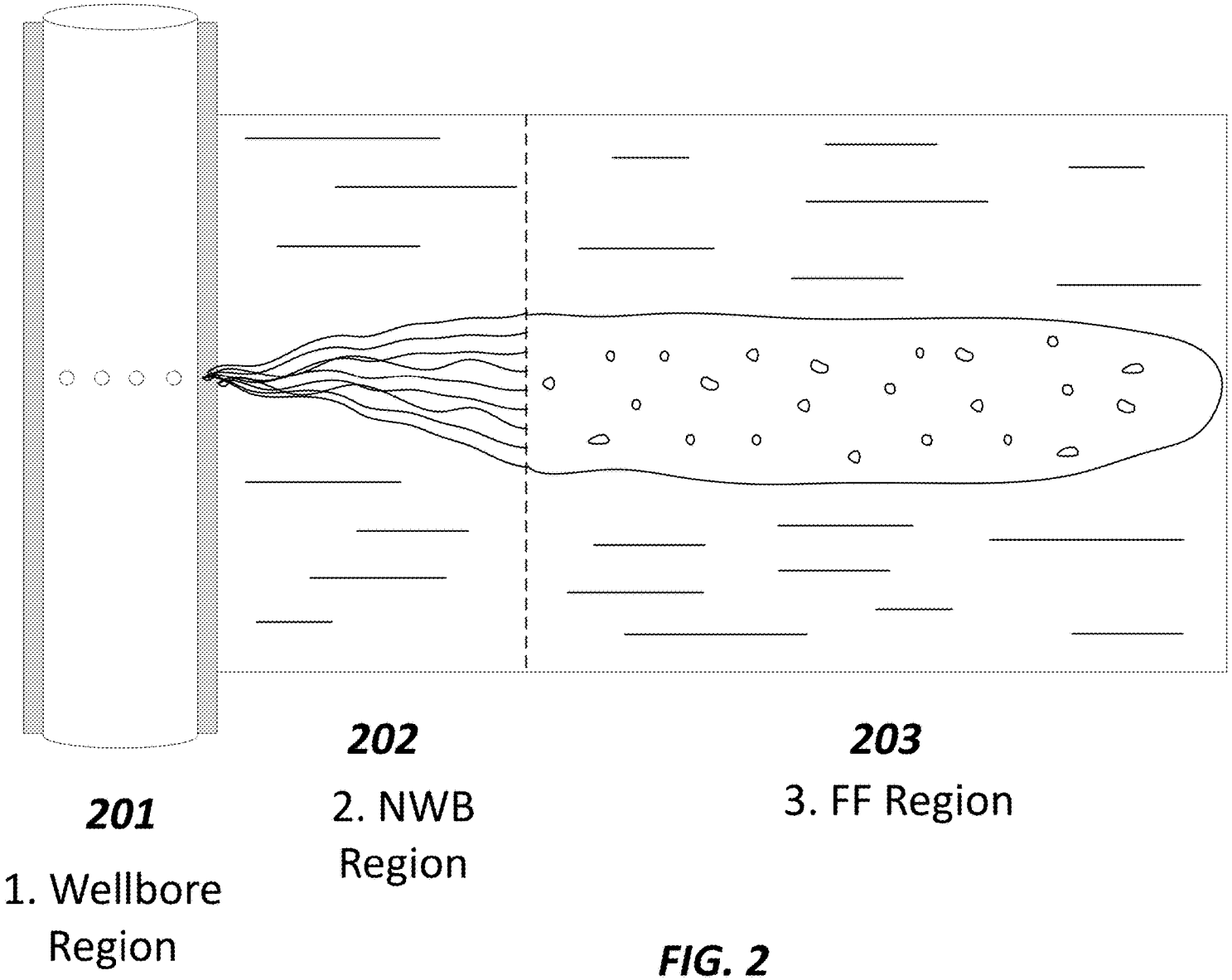
FIG. 2 illustrates three distinct hydraulic regions with increasing distance from the wellbore.

A model used in a method according to the present disclosure to analyze fracture properties from fracture pumping and pressure decay data assumes that hydraulic fractures induced by fluid pumping have three regions: 1) a wellbore region, 2) a near wellbore (NWB) region and 3) a far field (FF) region. FIG. 2 illustrates these three regions at 201, 202, and 203 respectively. In fracture analysis known in art prior to the present disclosure, the effect of the NWB region 202 is generally neglected. However, it has been determined that the NWB region 202 can have a substantial effect on the initial (early time) part of the post-shut-in pressure decay. Note that the term "shut in" is used in the art to mark time after the point when pumps are shut off (or the hydraulic functional equivalent) and the fluid injection stops.

Figure 3:
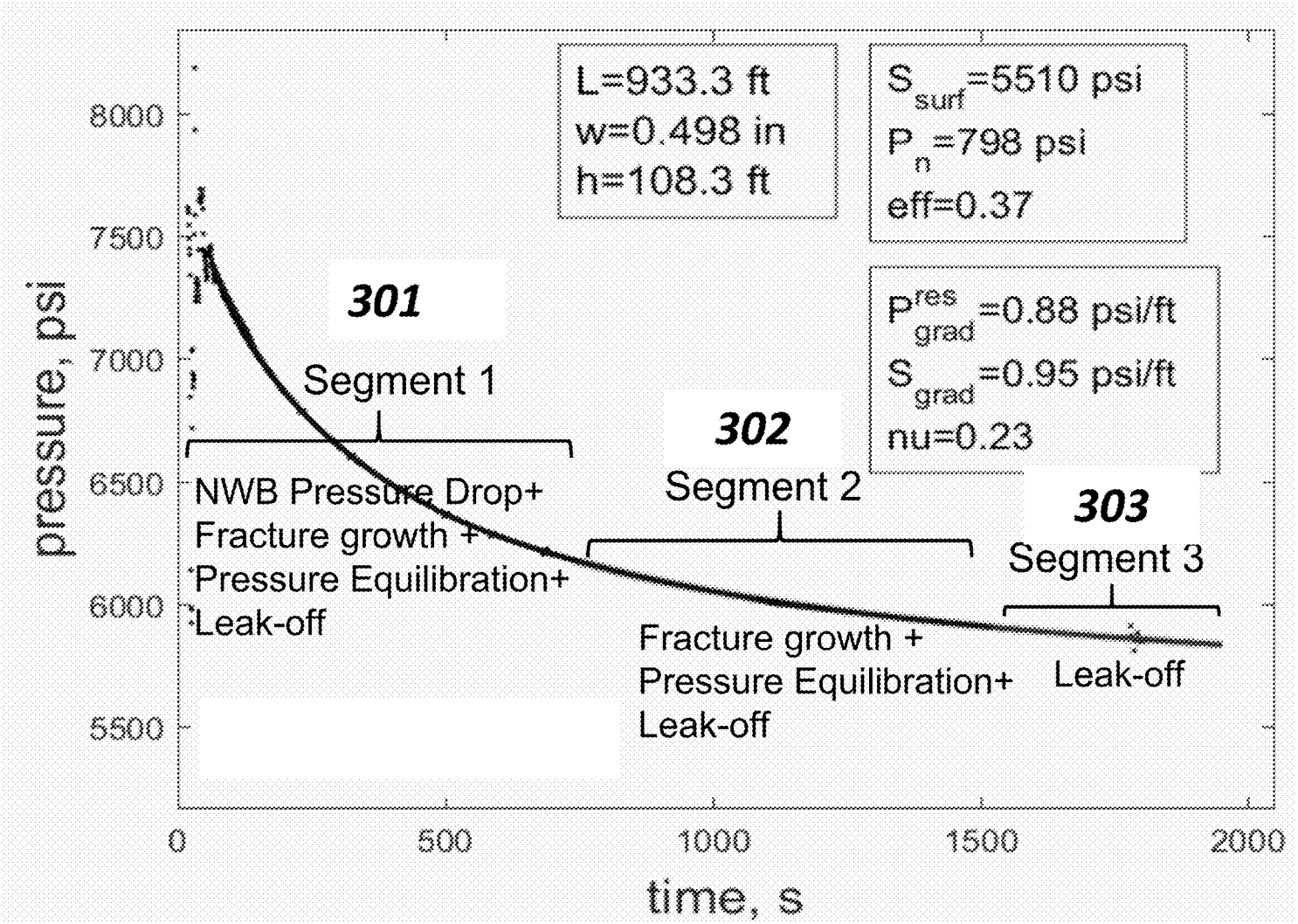
FIG. 3 shows post shut-in pressure decay resolved into 3 primary segments.

An attribute of the improved model used in a method according to the present disclosure takes account of the understanding that the pressure decay after initial shut in includes three segments each attributable to one of three different causes of pressure decay. FIG. 3 shows a graph of well pressure with respect to time immediately after the pumping of a stage (fracture fluid injection) ends. Neglecting the transient water hammer immediately post shut-in (shown by the dotted line at the very left of the graph), the subsequent pressure decay can be divided into 3 distinct segments. These segments are highlighted and correspond to the segments shown at 301, 302, and 303 in FIG. 3, respectively. There are some calculated values based on the presented method in FIG. 3. The three segments correspond to three sources of pressure decay; the sources include NWB region post-shut-in pressure drop, fracture growth pressure drop, and leak off pressure drop. Each of the three pressure decay segments, 301, 302, 303 is shown with the main respective sources of pressure drop that contribute to pressure decay in each region. For example, Segment 3 is dominated by leak-off while Segment 1 is dominated by NWB pressure loss.

Figure 4:
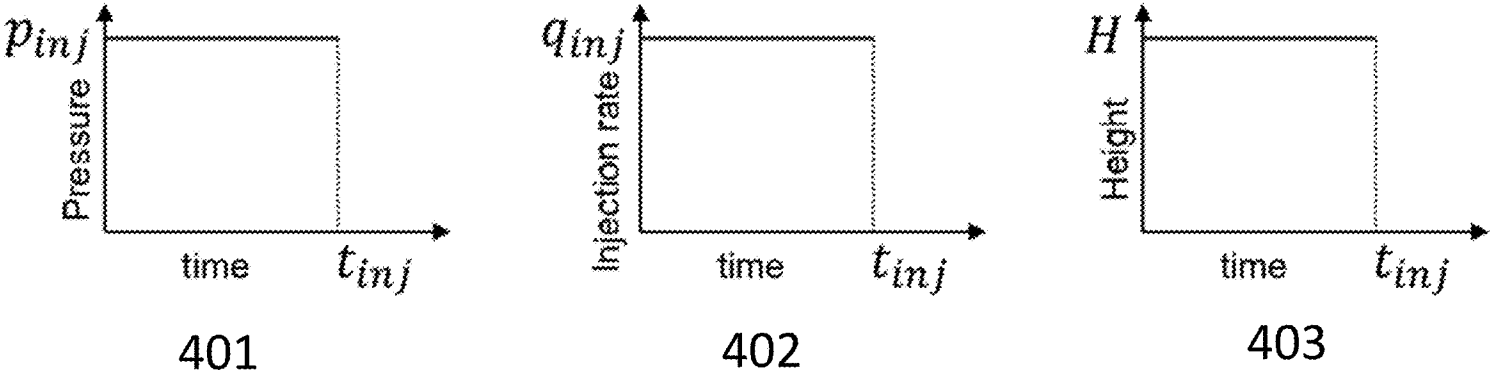
FIG. 4 shows some assumptions during stage pumping used in analysis according to the present disclosure.

During the fracture pumping stage, changes in pressure and injection rate are complicated. However, for purposes of the present disclosure, it may be assumed that both fluid pressure and fluid injection rate are constant during fracture treatment pumping and during PKN (Perkins-Kern-Nordgren, Perkins and Kern (1961); Nordgren (1972)) type fracture growth. The PKN model is a classical 2-dimensional (plain strain) fracture growth model which assumes a long fracturing length (hundreds of feet in length), limited but constant height (tens to hundreds of feet) and small width (measurable in millimeters) propagated in an infinite homogeneous isotropic linear elastic formation characterized by Young's modulus E, Poisson's ratio v (Kovalyshen 2010). The foregoing assumptions result in constant fracture height during fracture growth, and fracture width depending linearly on fracture height and net pressure. To summarize, the assumptions for analyzing pressure during the facture pumping stage are, as shown graphically in FIG. 4:

1. Constant fluid pressure throughout the pumping stage from start to end, at 401;
2. Constant fluid injection rate throughout the pumping stage from start to end, at 402;
3. Constant fracture height during fracture propagation throughout the pumping of a treatment, at 403; and
4. Fracture width is linearly related to fracture height and net pressure (difference between the fracturing fluid pressure and the closure pressure), independent of fracture length.

Calculating an Average Efficiency as a Function of Local Efficiency

Fluid efficiency, or simply, efficiency, is the fractional amount of fluid present in the fracture compared to the total volume of fluid injected. Efficiency is an important parameter for determining the fracture dimensions. Usually, fracture treatment stages with higher efficiency have larger fracture lengths and larger net pressures. The efficiency can vary between formations and even between different fracture treatment stages within one formation into which fracture fluid is pumped. Such variation can result from several causes, such as the existence of naturally occurring fractures, fissures, faults and variations in fracture fluid injection design, among others. Thus, according to the present disclosure an efficiency value is calculated for each fracture treatment stage and it is not assumed that the efficiency is constant for all stages. Here two types of efficiency will be considered: local efficiency, and average efficiency. Local efficiency correlates the volume rate of fracture growth, $q_{fg}$, to the injected volume rate, $q_{inj}$, and as it can be observed its value is not constant during the fracture fluid injection period. Average efficiency correlates the fracture volume at the end of the pumping stage to the whole injected volume during the same pumping stage, and it is a unique value for each stage. It should be mentioned that average efficiency can be calculated by averaging the local efficiency values during injection period. To calculate an average efficiency one can start with the mass conservation equation, as shown graphically in FIG. 1B at 111:

$$q_{inj}=q_{fg}+q_{leak} \tag{1}$$

Fracture growth ratio (local efficiency), ξ, can be defined as:

$$\xi(t)=\frac{q_{fg}(t)}{q_{inj}} \tag{2}$$

where $q_{fg}(t)$=fracture growth volume rate $$\left(\frac{dV_{fg}}{dt}\right)$$

associated with fracture growth, and $q_{inj}$=fluid injection volume rate $$\left(\frac{dV_{inj}}{dt}\right).$$

Note that ξ(t) is a function of time. Carter (Carter, 1957) derived a leak-off equation $$\left(u_{leak}=\frac{c_{leak}}{\sqrt{t_{eq}}}\right)$$

which is widely used in hydraulic fracturing modeling. The Carter leak-off equation is derived based on 1-dimensional fluid flow in porous media which is also a usable assumption for purposes of the present disclosure. Thus, assuming the leak-off ratio (1-ξ) can be calculated using the Carter leak-off equation yields:

$$1-\xi=\frac{q_{leak}(t)}{q_{inj}}=\frac{u_{leak}A_{leak}}{q_{inj}}=\frac{c_{leak}}{q_{inj}\sqrt{t_{eq}}}A_{fs} \tag{3}$$

where $c_{leak}$=Carter leak-off parameter, $t_{eq}$=equivalent leak-off time and fracture surface area, $A_{fs}$=2HL (area of one fracture wing). Assuming $t_{eq}=a_{eq}t$ and denoting $$C_{eq}=2H\frac{c_{leak}}{q_{inj}\sqrt{a_{eq}}}$$

results in:

$$1-\xi(t)=2H\frac{c_{leak}}{q_{inj}\sqrt{a_{eq}}\sqrt{t}}L(t)=\frac{c_{eq}}{\sqrt{t}}L(t) \tag{4}$$

-continued $$\xi(t)=1-\frac{c_{eq}}{\sqrt{t}}L(t) \tag{5}$$

The fracture growth can be calculated as:

$$\frac{dL}{dt}=\frac{q_{fg}(t)}{\overline{A}}=\frac{\xi(t)q_{inj}(t)}{\overline{A}} \tag{6}$$

where $\overline{A}$ is an average fracture cross-section (a constant nonzero value not critical as it will cancel out later in the derivation).

$$\frac{dL}{dt}=\frac{\left(1-\frac{c_{eq}}{\sqrt{t}}L(t)\right)q_{inj}}{\overline{A}} \tag{7}$$

$$\frac{dL}{dt}+\frac{c_{eq}q_{inj}}{\sqrt{t}\,\overline{A}}L=\frac{q_{inj}}{\overline{A}} \tag{8}$$

$$\text{Denoting}:\overline{q}=\frac{q_{inj}}{\overline{A}}$$

$$\frac{dL}{dt}+\frac{c_{eq}\overline{q}}{\sqrt{t}}L=\overline{q} \tag{9}$$

The above differential equation 9 can be solved with the initial condition L(t=0)=0. The solution is:

$$L(t)=\frac{1}{2c_{eq}^2\overline{q}}\left(2c_{eq}\overline{q}\sqrt{t}-1+e^{-2c_{eq}\overline{q}\sqrt{t}}\right) \tag{10}$$

It is illustrative to consider two extreme conditions; one with a very large leak-off and the opposite condition, a very small leak-off. For the large leak-off condition ($c_{eq}$ large or t is large) the exponential term in Eq. 10 will be negligible resulting in:

$$L(t)=\frac{\sqrt{t}}{c_{eq}} \tag{11}$$

The second extreme condition, in which leak-off is negligible, $c_{eq}\rightarrow 0$. In this case, the limit:

$$L(t)=\overline{q}t \tag{12}$$

Note these two extreme conditions are similar to the ones in Nordgren derivation.

The value of L at the end of an injection period can be calculated as $L_f=L(t=t_f)$:

$$L_f=\frac{1}{2c_{eq}^2\overline{q}}\left(2c_{eq}\overline{q}\sqrt{t_f}-1+e^{-2c_{eq}\overline{q}\sqrt{t_f}}\right) \tag{13}$$

Since fracture height and fracture width are constant, the average efficiency can be defined as the length of fracture with respect to the length of fracture with no leak-off, $$\eta_{av}=\frac{V_{fr}}{V_{fr}^{\eta=1}}=\frac{L_f}{L_f^{\eta=1}} \tag{14}$$

Where $L_f^{\eta=1}$ is defined as the length of fracture with no leak off and can be calculated as:

$$L_f^{\eta=1} = \frac{q_{inj}}{\bar{A}} t_f = \bar{q} t_f \tag{15}$$

resulting in $$\eta_{av} = \frac{1}{2c_{eq}^2 \bar{q}^2 t_f}\left(2c_{eq}\bar{q}\sqrt{t_f} - 1 + e^{-2c_{eq}\bar{q}\sqrt{t_f}}\right) \tag{16}$$

Denoting $\gamma = c_{eq}\bar{q}\sqrt{t_f}$ provides the expression:

$$\eta_{av} = \frac{1}{2\gamma^2}\left(2\gamma - 1 + e^{-2\gamma}\right) \tag{17}$$

The value of local efficiency at $t=t_f$ can be calculated as (using Eqs. 5, 14, 15) as:

$$\xi(t = t_f) = \xi_f = 1 - \frac{c_{eq}}{\sqrt{t}} L_f = 1 - \frac{c_{eq}}{\sqrt{t_f}} \eta_{av} \bar{q} t_f = 1 - \eta_{av} c_{eq} \bar{q} \sqrt{t_f} \tag{18}$$

$$\xi_f = 1 - \gamma \eta_{av} \tag{19}$$

Thus $$\gamma = (1 - \xi_f)/\eta_{av} \tag{20}$$

Substituting Eq. 19 into Eq. 17 provides the expression:

$$\eta_{av} = \frac{\eta_{av}^2}{2(1 - \xi_f)^2}\left(2\frac{(1 - \xi_f)}{\eta_{av}} - 1 + e^{-2\frac{(1-\xi_f)}{\eta_{av}}}\right) \tag{21}$$

Figure 5:
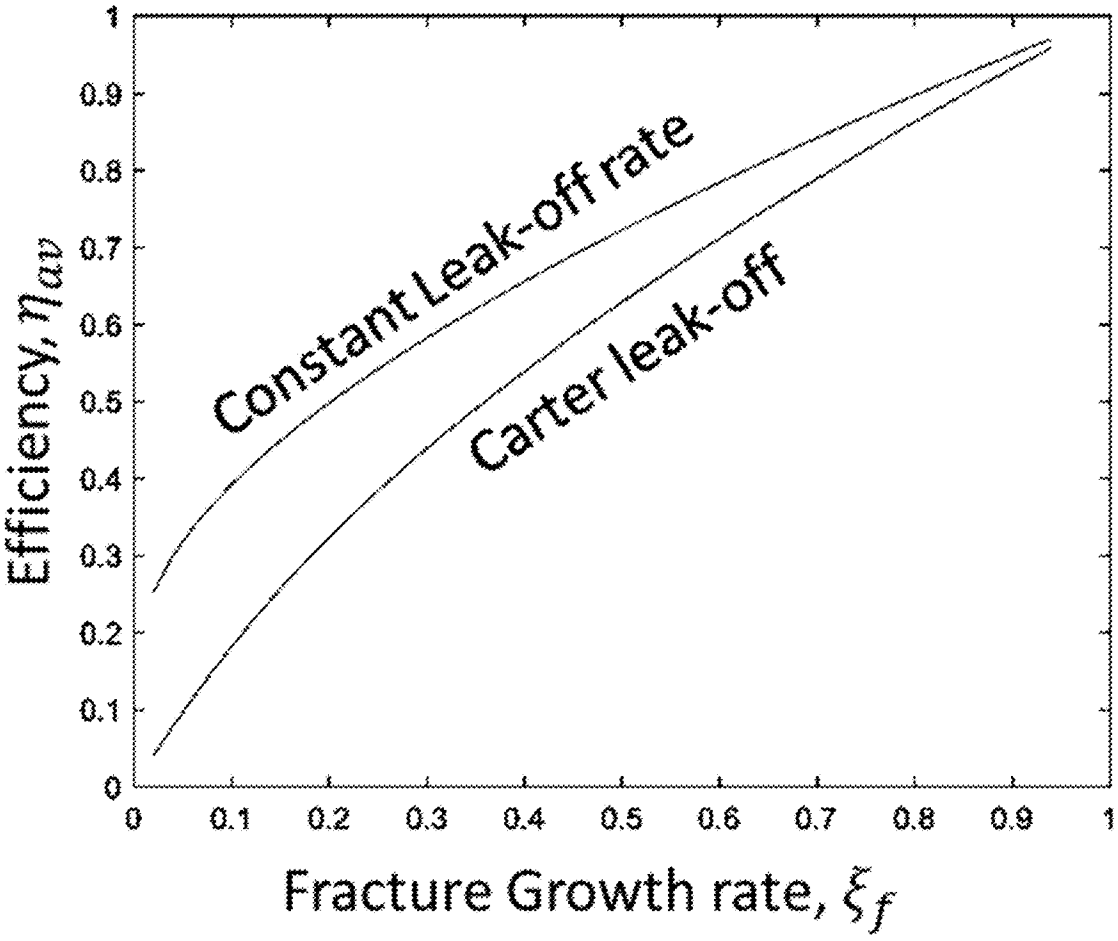
FIG. 5 shows the relation between fracture propagation ratio $\xi_f$ and average efficiency $\eta_f$.

Eq. 21 cannot be solved analytically, but it can be solved numerically. FIG. 5 shows the calculated relationship between $\xi_f$ and $\eta_{av}$ (solution to Eq. 21). FIG. 5 also compares the relation between $\xi_f$ and $\eta_{av}$ using Carter leak-off vs. using a constant leak-off condition (not a function of time).

Calculating Pressure Profile at the End of Pumping Stage

Figure 6:
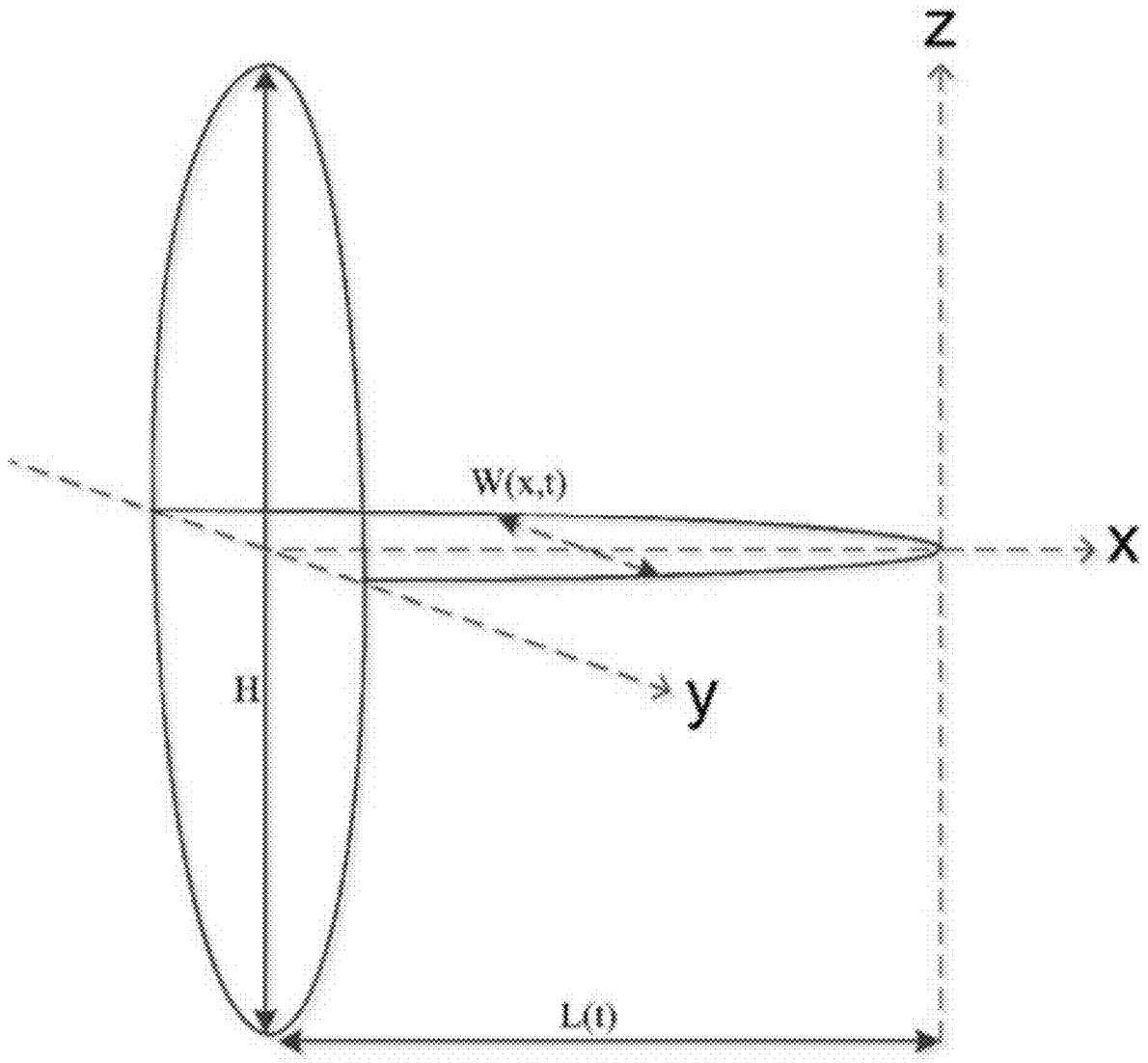
FIG. 6 shows geometry of a PKN (Perkins-Kern-Nordgren, see, Perkins and Kern (1961); Nordgren (1972)) fracture.

In order to calculate the pressure profile at the end of the pumping stage, one can use the same assumptions as mentioned earlier, additionally assuming the fracture cross-section is elliptical, referring to FIG. 6, at the end of the pumping stage:

$$\xi(t=t_f) = \eta_f L(t=t_f) = L_f \tag{22}$$

Assuming equal leak-off rate throughout the surface of the fracture, the volume rate in the fracture can be calculated as:

$$q(x,t_f) = (q_{inj} - q_{leak}(x,t_f) \tag{23}$$

where $q_{leak}(x)$ is the summation of the leak-off rate increments from the mouth of the fracture to point x. Using Carter leak-off gives:

$$q_{leak}(x_0, t_f) = \int_0^{x_0} \frac{c_{leak}}{\sqrt{t_f - t'(x_0)}} dx \tag{24}$$

where t' is the time that fracture front reaches a certain point of the fracture and leak-off starts. In order to calculate t' use the equation of the length propagation (Eq. 10) and calculate the time that is required to reach a particular fracture length. However, it is not analytically possible to invert Eq. 10. Therefore, the calculation may be performed numerically. However, for one extreme condition when leak-off is large, the following expression may be used:

$$L(t) = \frac{1}{2c_{eq}^2 \bar{q}}\left(2c_{eq}\bar{q}\sqrt{t}\right) = \frac{\sqrt{t}}{c_{eq}} \tag{25}$$

Thus:

$$t = c_{eq}^2 L(t)^2 \tag{26}$$

At the time of the end of pumping stage $t=t_f$, yields $$t_f = c_{eq}^2 L_f(t)^2 \tag{27}$$

Thus one can write:

$$t = t_f\left(\frac{L}{L_f}\right)^2 \tag{28}$$

Using the above relationship in Eq. 28 to calculate the leak-off at $t=t_f$:

$$q_{leak}(x_0, t_f) = \int_0^{x_0} \frac{c_{leak}}{\sqrt{t_f - t_f\left(\frac{x}{L_f}\right)^2}} dx = \frac{2}{\pi}(1 - \xi_f) q_{inj} \arctan\left(\frac{x_0}{\sqrt{L_f^2 - x_0^2}}\right) \tag{29}$$

The volume rate in the fracture can be written as:

$$q(x, t_f) = q_{inj} - q_{leak}(x, t_f) = q_{inj}\left(1 - \frac{2}{\pi}(1 - \xi_f)\arctan\left(\frac{x_0}{\sqrt{L_f^2 - x_0^2}}\right)\right) \tag{30}$$

Assuming linear flow in the fracture the volume rate using Darcy law is provided by:

$$q = -k_r \frac{k_{abs} A}{\mu} \frac{dp_n}{dx} \tag{31}$$

where $p_n$ is net pressure (difference between the pressure in the fracture, $p_f$ and minimum principal stress, $p_n = p_f - S_{min}$), $k_{abs}$ is the absolute permeability (depending on the cross-section shape), A is cross-sectional area, μ is viscosity of the fracture fluid in the fracture, and $k_r$ is the permeability reduction factor due to the effect of proppant, tortuosity, saturation degree, and other factors which reduce the permeability. Also, note that the value of viscosity in the fracture is substantially different from the values which are calculated in lab tests. The main reasons are the effect of shear rate on viscosity, the effect of proppant on viscosity, and the effect of temperature on viscosity.

Since both $k_r$ and μ are unknown, Eq. 31 may be rewritten as:

$$q = -\frac{k_{abs}A}{\mu_{ap}}\frac{dp_n}{dx},\ \mu_{ap} = \frac{\mu}{k_r} \tag{32}$$

Writing the equation in this form helps by having just one unknown parameter, $\mu_{ap}$ which is denoted as apparent viscosity. The details regarding calculation of this unknown will be studied later.

For elliptical cross section:

$$A = \frac{\pi H w}{4},\ k_{abs} = \frac{w^2}{16} \tag{33}$$

where w is the width of fracture, and H is the height of fracture. Also based on classical (see, Sneddon and Elliot (1946)) theory, the width of a pressurized fracture can be calculated as $$w = \frac{2H_f p_n}{E'} \tag{34}$$

where $p_n$ is net $$E' = \frac{E}{1-\nu^2}.$$

pressure, and Substituting Eq. 33 and Eq. 34 into Eq. 31, provides the expressions:

$$q(x, t_f) = -\frac{\pi H^4 p_n^3}{8E'^3\mu_{ap}}\frac{dp_n}{dx} = -\gamma p_n^3\frac{dp_n}{dx} \tag{35}$$

$$\gamma = \frac{\pi H^4}{8E'^3\mu_{ap}} \tag{36}$$

Combining eq. 23 and 35:

$$-\gamma p_n^3\frac{dp_n}{dx} = q_{inj}\left(1 - \frac{2}{\pi}(1-\xi_f)\arctan\left(\frac{x_0}{\sqrt{L_f^2 - x_0^2}}\right)\right) \tag{37}$$

Integrating Eq. 37 with the condition $p_n(x=0)=p_M$ results in:

$$p_n^4(x) = p_M^4 - \frac{4q_{inj}}{\gamma}\left(x - \frac{2}{\pi}(1-\xi_f)\left(\sqrt{L_f^2 - x^2} + x\arctan\left(\frac{x}{\sqrt{L_f^2 - x^2}}\right) - L_f\right)\right) \tag{38}$$

Figure 7:
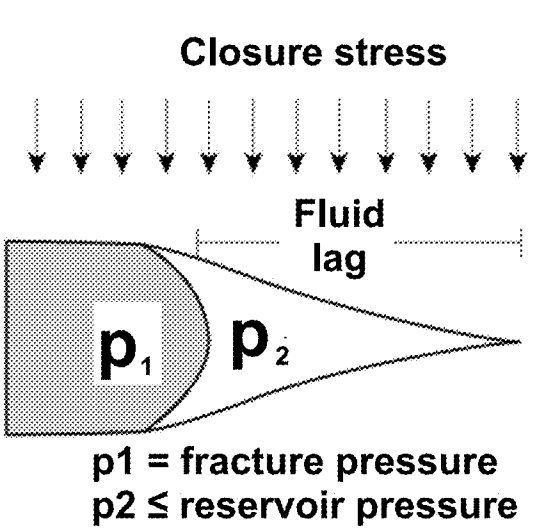
FIG. 7 shows a pressure profile and fluid lag in a fracture (see, Vahab and Khalili, 2001).
Figure 7:
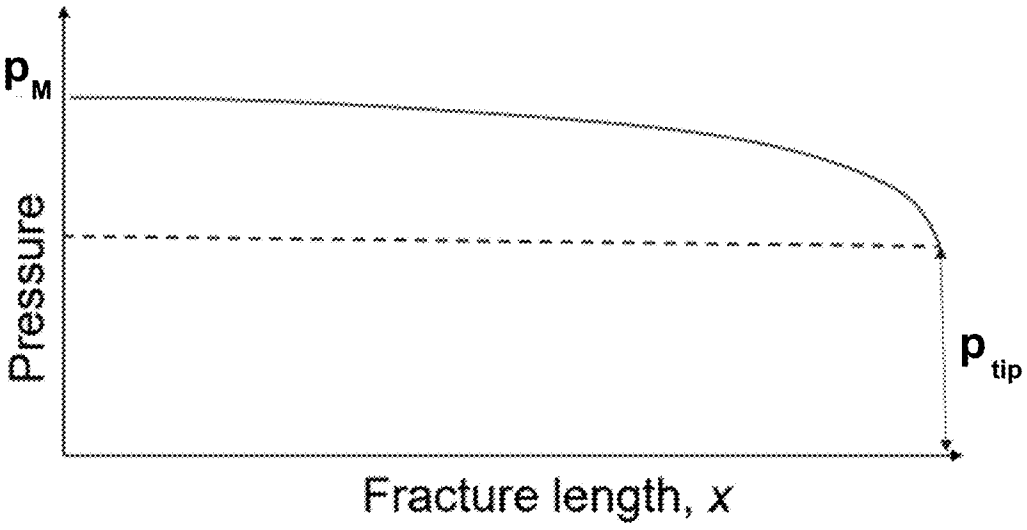

Note that $p_n(x=L_f)=p_{tip}$. Classical fracture mechanics predicts a small value for $p_{tip}$(~10 psi), however, observed data typically suggests a significantly larger value for $p_{tip}$(~100-400 psi) [Ref. Economides 1989; Chen, 2018; Jeffrey 1989, Vahab 2018]. Later derivation will show how to calculate the value of $p_{tip}$. One important and long recognized consideration is that the fracturing fluid never quite reaches the fracture tip; i.e., there is a "fluid lag" region at the fracture tip that increases the apparent toughness and tip pressure. FIG. 7 shows a pressure profile and fluid lag in a fracture (see, Vahab and Khalili, 2001).

An equation describing the pressure difference between fracture mouth pressure and facture tip pressure then can be written as:

$$p_M^4 = p_{tip}^4 + \frac{4q_{inj}L_f}{\gamma}\left(\xi_f + \frac{2}{\pi}(1-\xi_f)\right) \tag{39}$$

Using Eq. 36 results in:

$$p_M^4 = p_{tip}^4 + \frac{32E'^3\mu_{ap}q_{inj}L_f}{\pi H_f^4}\left(\xi_f + \frac{2}{\pi}(1-\xi_f)\right) \tag{40}$$

and thus:

$$\frac{L_f}{H_f^4} = (p_M^4 - p_{tip}^4)\frac{\pi}{32E'^3\mu_{ap}q_{inj}\left(\xi_f + \frac{2}{\pi}(1-\xi_f)\right)} \tag{41}$$

Observed effects of each parameter match the expected behavior:

- Longer fracture causes more pressure drop
- Higher viscosity causes larger pressure difference
- Higher height causes faster permeability and this will have lower pressure difference
- For higher efficiency the leak-off is lower and pressure at fracture mouth is higher Post Shut-In Stage Following the instantaneous shut-in (ISIP), as is known in the art, shut-in (cessation of pumping) causes water hammer. In this disclosure, pressure data obtained after the water hammer are considered. Also, in methods according to the present disclosure, the fracture is considered as being divided into three regions. Referring once again to FIG. 2, the regions are the wellbore region 201, the near-wellbore (NWB) region 202, and the far field (FF) region 203. The NWB region 202 has a complex shape and in it there often exist fracture turning, fracture twisting, branching, and fracture splitting. Also, generally, the NWB region 202 has a lower width and considerably lower permeability than the FF region 203. The size of the NWB region 202 can vary from a few well diameters to about 30 feet distance from the well. Due to the lower permeability in the NWB region 202 and the fact that in the NWB region, 202, fractures can initiate in a direction other than the preferred direction (normal to the minimum principal stress), it is frequently the case that post ISIP there is a pressure difference between the wellbore region 201 and the FF region 203. This pressure difference causes a rapid pressure drop post shut-in. This pressure drop is sometimes called pressure drop due to wellbore tortuosity, however, in this disclosure the immediate post shut in pressure drop is referred to as the near-wellbore (NWB) pressure loss (NWBPL), which is pressure loss attributable to the NWB region, shown at 202 in FIG. 2.

One of the novel aspects of a method according to the present disclosure is dividing the post ISIP (instantaneous shut-in pressure) pressure decay into three segments according to the dominant source of the pressure decay in each of the segments. The sources of the pressure decay are:

1. Leak-off: considered in all three segments
2. Pressure equilibration: Pressure equilibration in the fracture starts right after the ISIP and it is almost negligible in segment 3 as after a few minutes pressures across the fracture region will begin to equilibrate.
3. Fracture growth: Fracture growth can be a significant source of pressure decay right after the ISIP. However, its effect on the pressure decay trend diminishes very fast and it is completely negligible in segment 3.
4: Near-Wellbore Pressure Loss (NWBPL): This pressure loss is large in the first few minutes after shut-in. However, its effect becomes very small quickly and in segment 3 and the later part of segment 2 its effect on pressure decay is negligible.

As a reminder, FIG. 3 illustrates the sources of the pressure decay in each segment. In the well segment 301 NWBPL is dominant; In the NWB segment 302 all pressure decay sources can have comparable contribution; and in the FF segment 303 leak-off is the dominant source of the pressure decay. Before analyzing, one should also consider if the effects of fluid friction are important. Below, the effects of two fluid friction components are considered. Friction in the wellbore (pipe) and friction due to perforations. It should be noted that the effect of these two friction sources are negligible in the present analysis since both depend on the wellbore volume rate, which becomes very small quickly after ISIP.

Figure 8:
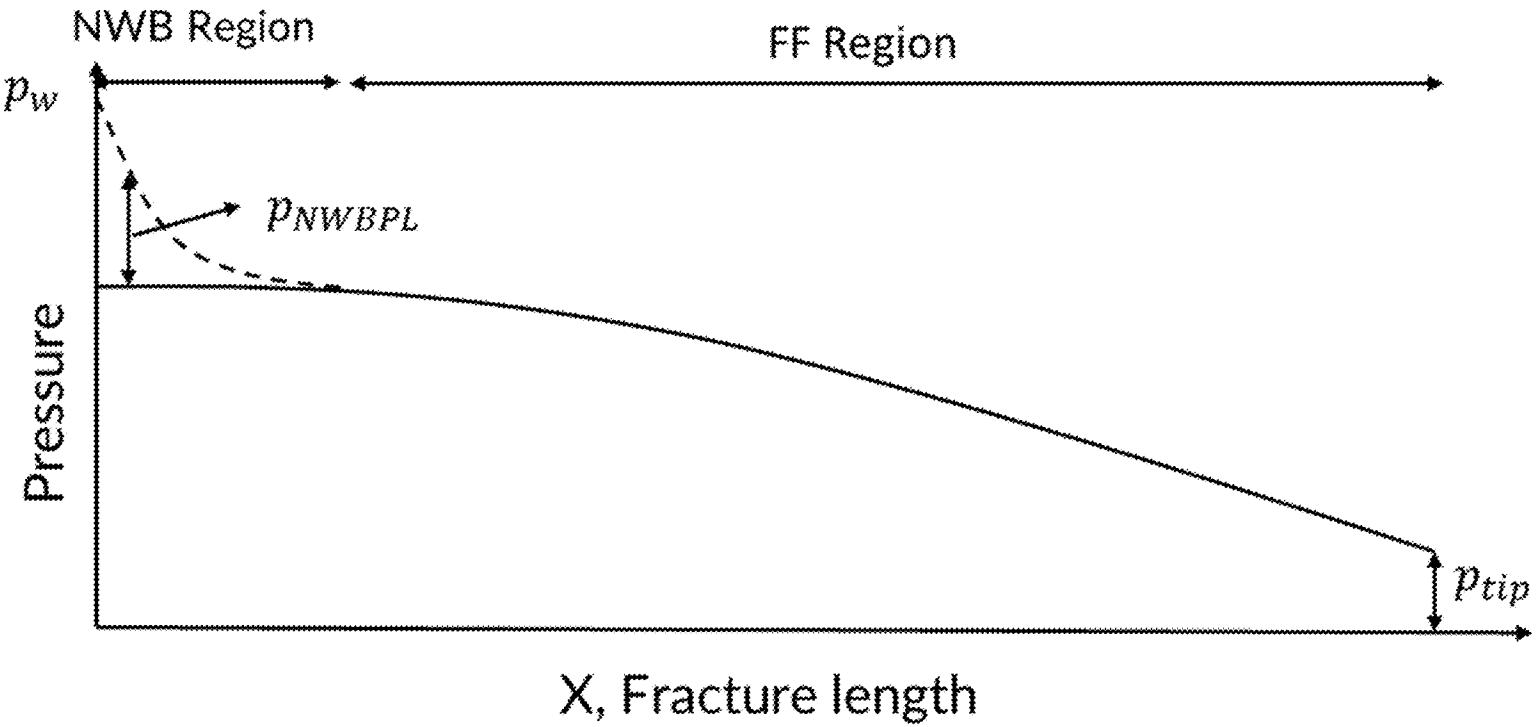
FIG. 8 shows the relation between pressures in the fracture.

FIG. 8 shows a graph illustrating a relationship between pressures in the NWB region and the FF region within a fracture. The pressure at the mouth of the fracture, which the on the well side of NWB region is represented by $p_w$ and can be calculated as:

$$p_w(t)=p_{wh}(t)-p_{fr}^{perf}(t)-p_{fr}^{pipe}(t) \tag{42}$$

where $p_{wh}$=pressure in the wellhead. Usually, $p_{wh}$ is usually the only pressure measurement data that is available. Again, note that a few minutes after ISIP $p_{wh}(t)\approx p_w(t)$. Next observe at the relationship between the $p_w$ and the pressure in the mouth of the FF region, $p_M(t)=p(x=0, t)$. The difference between these two pressures is the NWBPL. This results in:

$$p_M(t)=p_w(t)-p_{NWBPL}(t) \tag{43}$$

Pressure Decay Due to Fracture Growth and Leak-Off (Segment 2)

The focus of this section is on the decay of the average pressure (FF region) in segment 2, shown in FIG. 2 at 203. It should be noted that in segment 2 pressure is not uniform in the FF region and the effect of pressure equilibration is present. The average pressure in FF region can be denoted as $p_{av}(t)$:

$$p_{av}(t)=\int_{x=0}^{l_f} p_f(x,t)dx \tag{44}$$

Note that $p_f(x,t)$ is the pressure in the fracture which is function of both time and position (pressure is not uniform in the fracture). The mass conservation expression for the FF region can be written as:

$$q_{fc}-q_f=-q_{fg}-q_l \tag{45}$$

where $q_f$ is the volume rate from NWB region (202 in FIG. 2) to FF region, $q_{fg}$=volume rate associated with fracture growth, $q_l$ volume rate associated with leak-off, and $q_{fc}$=volume rate associated with fracture compressibility. To complete the relationship, it is necessary to formulate each of the foregoing volume rates. Volume rate due to fracture growth mainly should depend on the fracture propagation pressure, $p_{prop}$, which can be calculated as $$p_{prop}=\overline{p}_n-p^* \tag{46}$$

where $\overline{p}_n$ is the average net pressure (propagation pressure) and $p^*$ is an unknown pressure which determines the minimum required net pressure to cause fracture growth. The procedure to calculate the minimum required pressure will be explained at the end of this section. The average net pressure can be calculated as $$\overline{p}_n(t)=p_{av}(t)-S_{min} \tag{47}$$

Based on the literature (Weijers 2000, Economides 1989), the rate of fracture growth, $u_{fg}$, depends on the propagation pressure $p_{prop}$ as:

$$u_{fg}=c_{fg}p_{prop}^{\ r} \tag{48}$$

where $c_{fg}$ is an unknown parameter, and r is an unknown power and based on the literature $0.6<r<1.6$. Here for simplicity it is acceptable to set r=1. Thus, the volume rate associated with the fracture growth can be calculated as:

$$gfg=u_{fg}A_{fg} \tag{49}$$

where $A_{fg}$ is the volume associated with the fracture growth. This volume is also pressure dependent thus $A_{fg}\propto p_{prop}$ (height assumed to be constant and width assumed pressure dependent). Thus, because $$q_{fg}\propto p_{prop}^{\ 2} \tag{50}$$

and because other parameters needed to calculate $q_{fg}$ are unknown, one can compare $q_{fg}$ at each time post ISIP to its value before the shut-in. Using this results in:

$$q_{fg}=q_{fg}^{inj}\left(\frac{p_{prop}}{p_{prop}^0}\right)^2 \text{ for } p_{rop}>0 \tag{51}$$

where $q^{inf}_{fg}$ is the volume rate associated with fracture growth at the end of injection period. Based on the definition of fracture growth ratio, $\xi_f$, it is possible to calculate $q^{intf}_{fg}$ as $$q_{fg}^{\ inj}=\xi_f q_{inj} \tag{52}$$

Thus $q_{fg}$ can be calculated as:

$$q_{fg}=\xi_f q_{inj}\left(\frac{p_{prop}}{p_{prop}^0}\right)^2 \text{ for } p_{rop}>0 \tag{53}$$

Note that for the condition which $p_{prop}<0$, namely, when the pressure is below the minimum stress, then $q_{fg}=0$. Note this is a very simplified fracture growth relationship and other relationships could also be used. Various other relations for fracture growth did not change the results significantly. Looking at the leak-off volume rate, $q_l$. Calculation of the leak-off in this segment is complicated since there are both fracture extension and the decrease of the leak-off rate in the existing part of the fracture. During Fracture Extension, fracture grows slowly (an increase of leak-off), and the leak-off rate from the existing part of fracture decreases (a decrease of leak-off). For simplicity assume a leak-off increase due to fracture growth and the leak-off decrease due to reservoir pressurization cancel each other and what remains is a constant leak-off rate which is equal to its value at the end of the pumping stage:

$$q_l=(1-\xi_f)q_{inj} \tag{54}$$

Determining the value of $q_f$ which is the flow from the NWB region to the FF region may be explained as follows. This flow rate is large during Segment 1, shown in FIG. 3 at 301, however, it becomes negligible quickly and can be neglected in segment 2 as shown in FIG. 3 at 302. Note in segment 2, at 302

$$q_f \approx q_w = \beta_w V_w \frac{dp_w}{dt}.$$

Since $\beta_{fr} >> \beta_w$ and $V_{fr} >> V_w$ this flow rate can be neglected. Here β=compressibility. $V_{fr}$=volume of the fracture and $V_w$=volume of wellbore.

The last volume rate that should be defined is the volume rate associated with the fracture compressibility. This can be calculated as, $$q_{fc} = \beta_{fr} V_{fr} \frac{dp_{av}}{dt} = \beta_{fr} V_{fr} \frac{d(\overline{p_n} + S_{min})}{dt} = \beta_{fr} V_{fr} \frac{d\overline{p_n}}{dt} \tag{55}$$

$\beta_{fr}$ is the compressibility of the fracture. Here the average compressibility is used just as previously average pressure was used. Compressibility of the fracture, $\beta_{fr}$ has three components: compressibility of the fracture fluid, change of fracture area due to pressure change, and change of proppant content due to pressure change. Among these three components, the change of fracture area due to pressure change is dominant. In such case:

$$\beta_{fr} = \frac{1}{A}\frac{dA}{dp} \tag{56}$$

Assuming an elliptical fracture surface, the fracture area is:

$$A = \frac{\pi}{4} wH \tag{57}$$

Where w=width of fracture, H=height of fracture. Based on Sneddon and Elliot (1946), the average width is, where $S_{min}$ is the minimum principal stress:

$$\overline{w} = \frac{(1-\nu)H}{G}(p_{av} - S_{min}) = \frac{2H}{E'}\overline{p_n} \tag{58}$$

Assuming H is essentially constant during pressure decay, the average fracture compressibility can be calculated as:

$$\beta_{fr} = \frac{2H}{\overline{w}E'} = \frac{1}{\overline{p_n}} \tag{59}$$

Note $S_{min}$ is assumed to be constant with respect to time. Now that all volume rates have been formulated, the mass conservation relation Eq. 45 may be written as:

$$\beta_{fr} V_{fr} \frac{d\overline{p_n}}{dt} = -\xi_f q_{inj}\left(\frac{p_{prop}}{p_{prop}^0}\right)^2 - q_{inj}(1-\xi_f) \tag{60}$$

where $\beta_{fr}V_{fr}$ is substantially constant since $V_{fr} \propto \overline{p}_n$ and $\beta_{fr} \propto 1/(\overline{p}_n)$. Thus $\beta_{fr}V_{fr} = \beta_{0fr}V_{0fr}$, yielding following relationship:

$$\beta_{fr} V_{fr} = \eta_{av} V_{inj} \frac{1}{\overline{p_n}^0} \tag{61}$$

Equation 61 can be simplified ($V_{fr} = \eta_{av} V_{inf}$):

$$\frac{\eta_{av} V_{inj}}{\overline{p_n}^0}\frac{d\overline{p_n}}{dt} + \xi_f q_{inj}\left(\frac{\overline{p_n} - p^*}{\overline{p_n}^0 - p^*}\right)^2 + q_{inj}(1-\xi_f) = 0 \tag{62}$$

Using the definition of injection time, $$t_{inj} = \frac{V_{inj}}{q_{inj}},$$

provides the expression $$\frac{d\overline{p_n}}{dt} + \frac{\xi_f \overline{p_n}^0}{t_{inj}\eta_{av}}\left(\frac{\overline{p_n} - p^*}{\overline{p_n}^0 - p^*}\right)^2 + \frac{\overline{p_n}^0}{\eta_{av} t_{inj}}(1-\xi_f) = 0 \tag{63}$$

The above differential equation, Eq. 63 can be solved analytically. Initial condition is $\overline{p}_n(t=0) = \overline{p}_{n0}$. After solving this differential equation, the final equation for $\overline{p}_n$ can be written as:

$$\overline{p_n} = p^* + \tag{64}$$

$$(\overline{p_n}^0 - p^*)\sqrt{\frac{1-\xi_f}{\xi_f}}\, tg\left[\arctan\left(\sqrt{\frac{\xi_f}{1-\xi_f}}\right) - \frac{t}{t_{inj}}\frac{\overline{p_n}^0}{\overline{p_n}^0 - p^*}\frac{\sqrt{\xi_f(1-\xi_f)}}{\eta_{av}}\right.$$

Thus, $$\text{in} + p^* + (\overline{p_n}^0 - p^*)\sqrt{\frac{1-\xi_f}{\xi_f}}\, tg\left[\arctan\left(\sqrt{\frac{\xi_f}{1-\xi_f}}\right) - \frac{t}{t_{inj}}\frac{\overline{p_n}^0}{\overline{p_n}^0 - p^*}\frac{\sqrt{\xi_f(1-\xi_f)}}{\eta_{av}}\right. \tag{65}$$

The only unknown here is the value of p*. This pressure can be called fracture propagation pressure since below that pressure there is no fracture growth. In order to calculate the value of the fracture propagation pressure p*, one can find a point in the pressure data after which further pressure decay is primarily due to leak-off. To do this, one can fit a Carter leak-off function to the end part (the last part of the measured pressure with respect to time of post-shut-in pressure decay) of the pressure data and calculate the point that pressure decay deviates from the Carter leak-off. Carter leak-off rate depends on time as:

$$u_{leak} = \frac{c_{leak}}{\sqrt{t_{eq}}} \tag{66}$$

Defining Carter time as $\tau = t/\sqrt{t_{eq}}$ there will be a linear relationship between the pressure decay due to leak-off and τ. This line can be defined as:

$$\tau = \frac{t}{\sqrt{t_{eq}}} \tag{67}$$

$$p_{Carter} = c_1^* - c_2^* \tau \tag{68}$$

Figure 10:
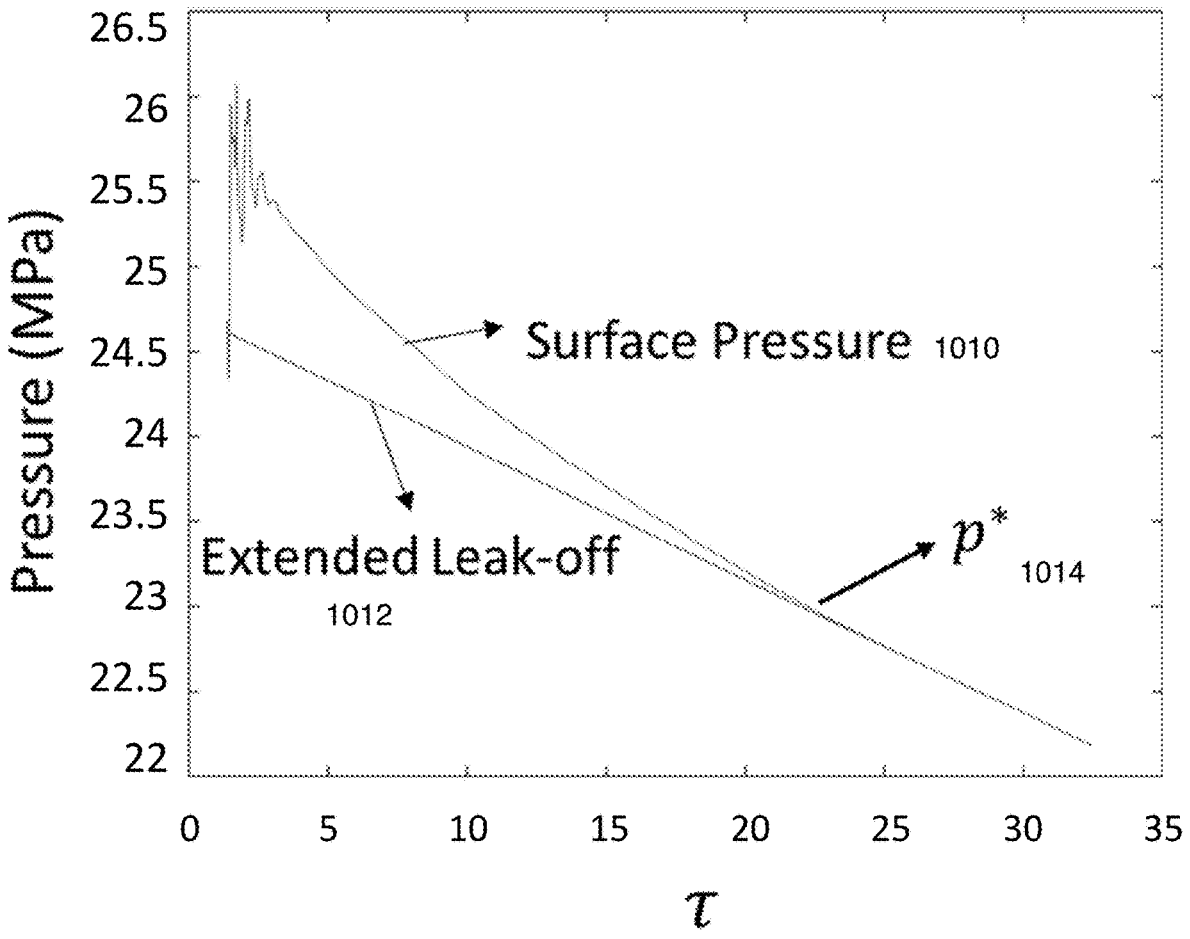
FIG. 10 shows calculation of p*.

The point that pressure decay data deviates from $p_{Carter}$ is (t*,p*). FIG. 10 illustrates an example of this calculation for p*. Note that since p* is the pressure below which there is no fracture growth, one can use the assumption that pressure at the fracture tip $p_{tip}$=p*. This assumption will reduce one of the previously unknown parameters.

Pressure Decay Due to Leak-Off (Segment 3, No Fracture Growth)

This subsection shows the pressure decay relation of the average pressure for Segment 3, shown in FIG. 3, at 303, of the pressure decay in which the only source of the pressure decay is leak-off (no fracture growth). Recall that FIG. 3. shows a measured set of data as well as an overlaying fit of modeled data. Because there is no fracture growth considered, the decrease of the leak-off rate should be considered. Thus the leak-off rate can be written as:

$$q_l = (1-\xi_f) q_{inj} \frac{\sqrt{a_{eq} t_{inj}}}{\sqrt{t + a_{eq} t_{inj}}} \frac{p_{av} - p_{res}}{p_{av}^0 - p_{res}} \tag{69}$$

where the last two term are added to consider the effect of pressure dependent Carter leak-off.

The differential equation for pressure can be written as:

$$\beta_{fr} V_{fr} \frac{d\overline{p_n}}{dt} + (1-\xi_f) q_{inj} \frac{\sqrt{a_{eq} t_{inj}}}{\sqrt{t + a_{eq} t_{inj}}} \frac{p_{av} - p_{res}}{p_{av}^0 - p_{res}} = 0 \tag{70}$$

in Segment 2 (FIG. 3, 302) the assumption was that value of $\beta_{fr} V_{fr}$ remained constant and equal to its initial value. This assumption is correct if proppant in the fracture does not affect the fracture compressibility. However, when net pressure becomes small it means the width is small and thus proppant can change the compressibility. The effect of proppant on compressibility can be considered using parameter $c_{pr}$. Thus $$\beta_{fr} V_{fr} = \eta_{av} V_{inj} \frac{1}{c_{pr} \overline{p_n}^0} \tag{71}$$

where $c_{pr}$=1 when the width is substantially larger than the proppant width (proppant particle diameter or size). However, when the width becomes close to the width of the proppant pack, the $c_{pr}$>1. To calculate the value of $c_{pr}$ one can define $V_{pr}$ as the volume of the injected proppant. Additionally, assume all the proppant stays in the fracture. Now one can compare the volume of the fracture with the volume of the proppant and define an empirical equation to calculate the value of the $c_{pr}$. Assuming if $V_{fr}$>$c_v V_{pr}$ there is no effect due to proppant and $c_{pr}$=1. Where $c_v$ is unknown, assume $c_v$=2. Also, in order to calculate the increase of the compressibility, one can assume a linear increase of the compressibility from the initial compressibility to the compressibility of the proppant pack as the volume decreases. The volume of the fracture depends on the net pressure (length and height assume to be constant and width to be variable). Then:

$$c_{pr} = 1 + \left(c_{pr}^{max} - 1\right) \frac{p_n^{cr} - \overline{p_n}}{p_n^{cr}} \text{ for } \overline{p_n} < p_n^{cr} \tag{72}$$

$$p_n^{cr} = \overline{p_n}^0 \frac{c_v V_{pr}}{\eta_{av} V_{inj}} \tag{73}$$

where $c_{pr}^{max}$ is the maximum value of $c_{pr}$ and happens when fracture is closed $\overline{p}_n$=0, $p_{cr}$ n is the critical net pressure for which $V_{fr}$=$c_v V_{pr}$. The value of the $c_{pr}^{max}$ can be calculated using the value of the $\beta_{fr} V_{fr}$ when the fracture is closed $$(\beta_{fr} V_{fr})_{closed} = \beta_{pr} V_{pr} = \eta_{av} V_{inj} \frac{1}{c_{pr}^{max} \overline{p_n}^0} \tag{74}$$

$$c_{pr}^{max} = \frac{\eta_{av} V_{inj}}{\beta_{pr} \overline{p_n}^0 V_{pr}} \tag{75}$$

$\beta_{pr}$ is the compressibility of the proppant pack and based on literature we can use $\beta_{pr}$=0.011/MPa. Eqs. 72-75 allow calculating $c_{pr}$.

An equation for the pressure decay of the average pressure in Segment 3 is:

$$\eta_{av} V_{inj} \frac{1}{c_{pr} \overline{p_n}^0} \frac{d\overline{p_n}}{dt} + (1-\xi_f) q_{inj} \frac{\sqrt{a_{eq} t_{inj}}}{\sqrt{t + a_{eq} t_{inj}}} \frac{p_{av} - p_{res}}{p_{av}^0 - p_{res}} = 0 \tag{76}$$

$$\text{Simplifying as: } \frac{d\overline{p_n}}{dt} + \frac{\sqrt{a_{eq} t_{inj}}}{\sqrt{t + a_{eq} t_{inj}}} (p_{av} - p_{res}) = 0 \tag{77}$$

$$\frac{dp_{av}}{dt} + \frac{\psi}{\sqrt{1 + \frac{t}{a_{eq} t_{inj}}}} (p_{av} - p_{res}) = 0 \tag{78}$$

$$\text{where } \psi = \frac{(1-\xi_f) c_{pr} \overline{p_n}^0}{\eta_{av} t_{inj} \left(p_{av}^0 - p_{res}\right)} \tag{79}$$

Solving differential Eq. (78) provides the expression $$p_{av}(t) = p_{res} + c_3 \exp\left(-2\psi a_{eq} t_{inj} \left(1 + \frac{t}{a_{eq} t_{inj}}\right)^{1/2}\right) \tag{80}$$

where c and ψ are the two fitting parameters. Parameter ψ can be used to calculate the efficiency as $$\xi_f = 1 - \frac{\psi \eta_{av} t_{inj} \left(p_{av}^0 - p_{res}\right)}{c_{pr} \overline{p_n}^0} \tag{81}$$

Pressure Equilibration in the Fracture

Equations up to this point (Eqs. 64, 65, 80, and 81) are required to calculate the decay of the average pressure in the FF region post-shut-in. Additionally needed is the pressure at the mouth of the FF region, $p_M$. The relation between the average net pressure and the max net pressure (mouth pressure) is usually defined using parameter βs:

$$\beta_s = \frac{\overline{p_n}}{p_n^M} \tag{82}$$

Figure 11:
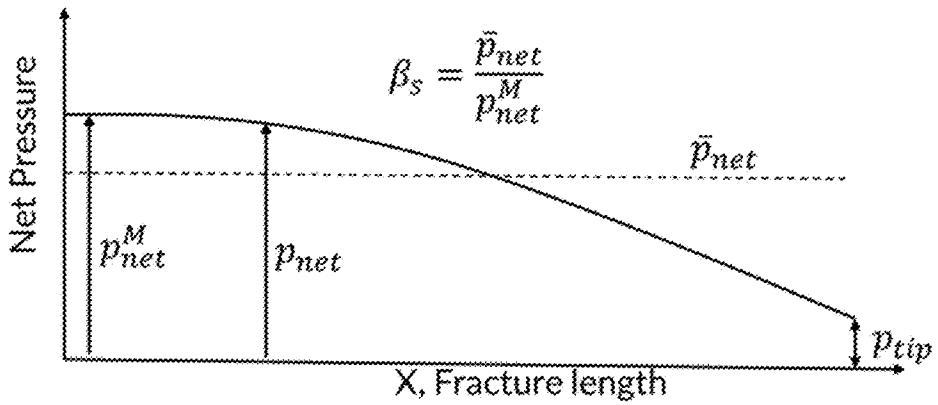
FIG. 11 shows examples of $\beta_s$ values (see, Economides and Nolte, 1983).

The value of βs during the pumping stage depends on several parameters. Based on Nolte (1979, 1991) the value of βs depends mainly on the reduction in fracture fluid viscosity from the well to the fracture tip resulting from thermal and shear degradation. The relationship between net pressure and fracture length (X) is depicted in FIG. 11 in panel A. The fracture fluid viscosity reduction mainly depends on the fluid type, length of the fracture, and the temperature of the formation. FIG. 11 in panel B, adopted from Smith and Montgomery (2015), demonstrates some numerically calculated values for βs.

As the value of the βs shows, the pressure in the fracture at the time of shut-in is not uniform. It is useful for a method according to the present disclosure to determine the time needed to reach pressure equilibrium in the fracture. Previously it was assumed that pressure equilibration is very fast and that there is substantially uniform pressure quickly (after a couple of seconds) after shut-in. For the following analysis, assume a very simplified pressure equation for the fracture. For example a pressure equation derived using the PKN fracture growth model with $p_{tip}=0$ may be used. Further assume the fracture fluid is Newtonian and there is no leak-off. Net pressure can be written as:

$$p_n = p_n^M\left(\frac{x}{l}\right)^{1/4} \tag{83}$$

Thus the average net pressure can be calculated as:

$$p_n^{ave} = \frac{\int_{x=0}^{l} p_n dx}{l} = 0.8p_n^M \tag{84}$$

Figure 12:
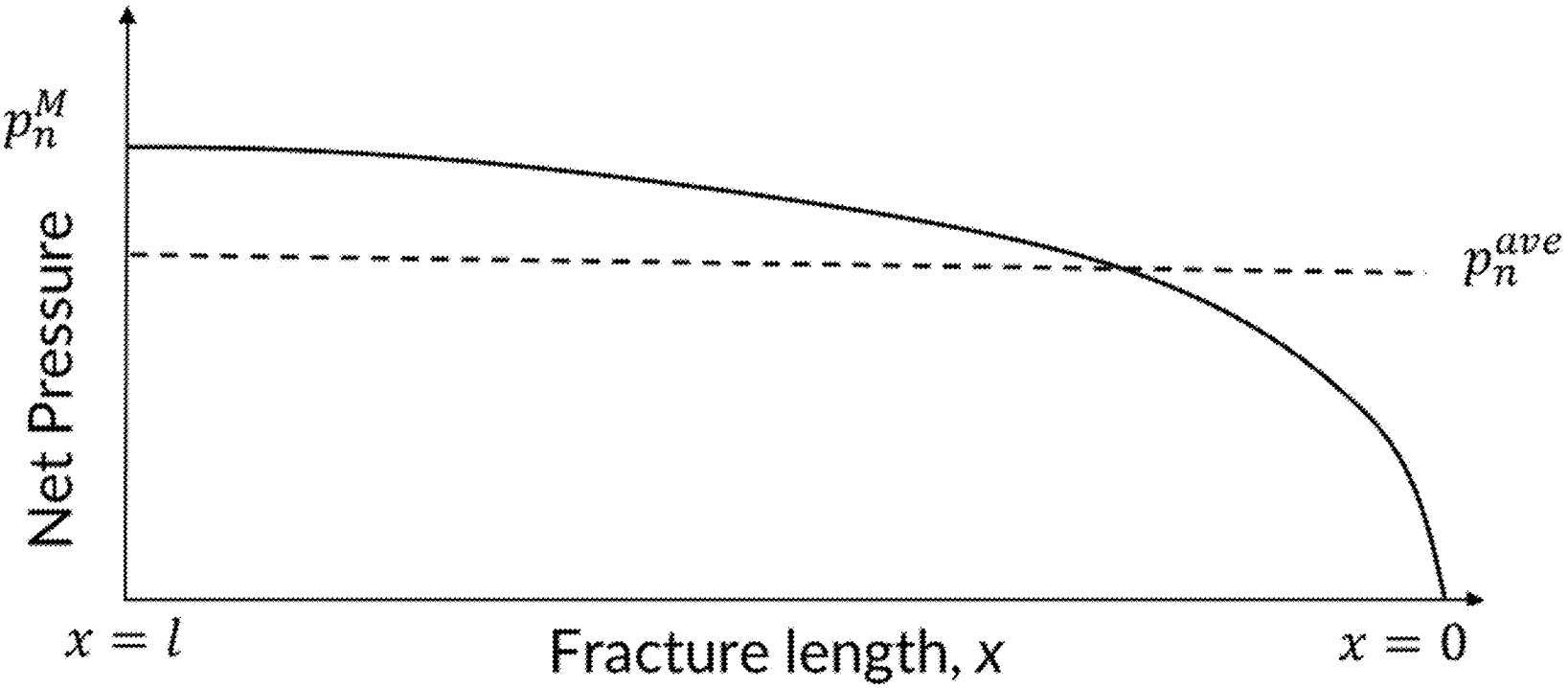
FIG. 12 shows simplified pressure in the fracture as a function of distance from wellbore using the PKN assumptions.

FIG. 12 shows the profile of net pressure, $p_n$, as a function of distance (x) from the wellbore and the average net pressure.

Figure 13:
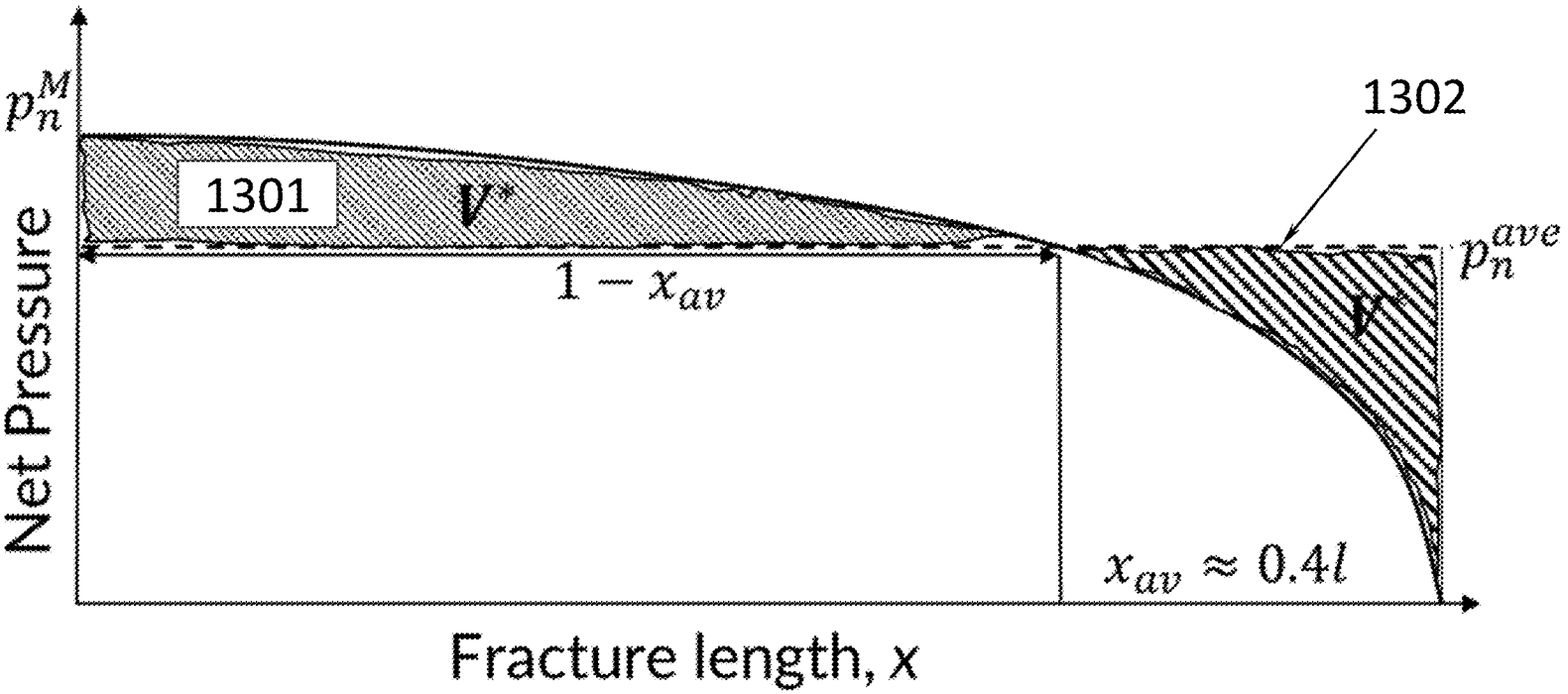
FIG. 13 shows the volume V* that should be moved to reach equilibrium.

To calculate the volume that is needed to move in for the fracture to reach equilibrium, and referring to FIG. 13, shaded regions of volume V* (the volume V* above the average net pressure $p_n^{ave}$ at 1301 balances out the same volume V* below the average net pressure at 1302). The volume of the fracture depends on the net pressure. This is due to the fact that the height and length of the fracture are constant and fracture width linearly depends on the net pressure. The fracture can be divided into two parts: a part with pressure above the average pressure and a part with the pressure below the average pressure. $x_{av}$ is the point along the length of the fracture that net pressure reaches the average pressure $p_n^{ave}$ and can be calculated as:

$$x_{ave} = l\left(\frac{p_n^{ave}}{p_n^M}\right)^4 = 0.4l \tag{85}$$

To reach uniform (equilibrium pressure) pressure the volume V* should move from the first part (part with $x>x_{ave}$) of the fracture to the second part (where $x<x_{ave}$). This volume can be calculated as $$V^* = V_{fr}\frac{p_{ave}x_{ave} - \int_{x=0}^{x_{ave}} p_n dx}{p_{ave}l} = 0.08V_{fr} \tag{86}$$

Figure 14:
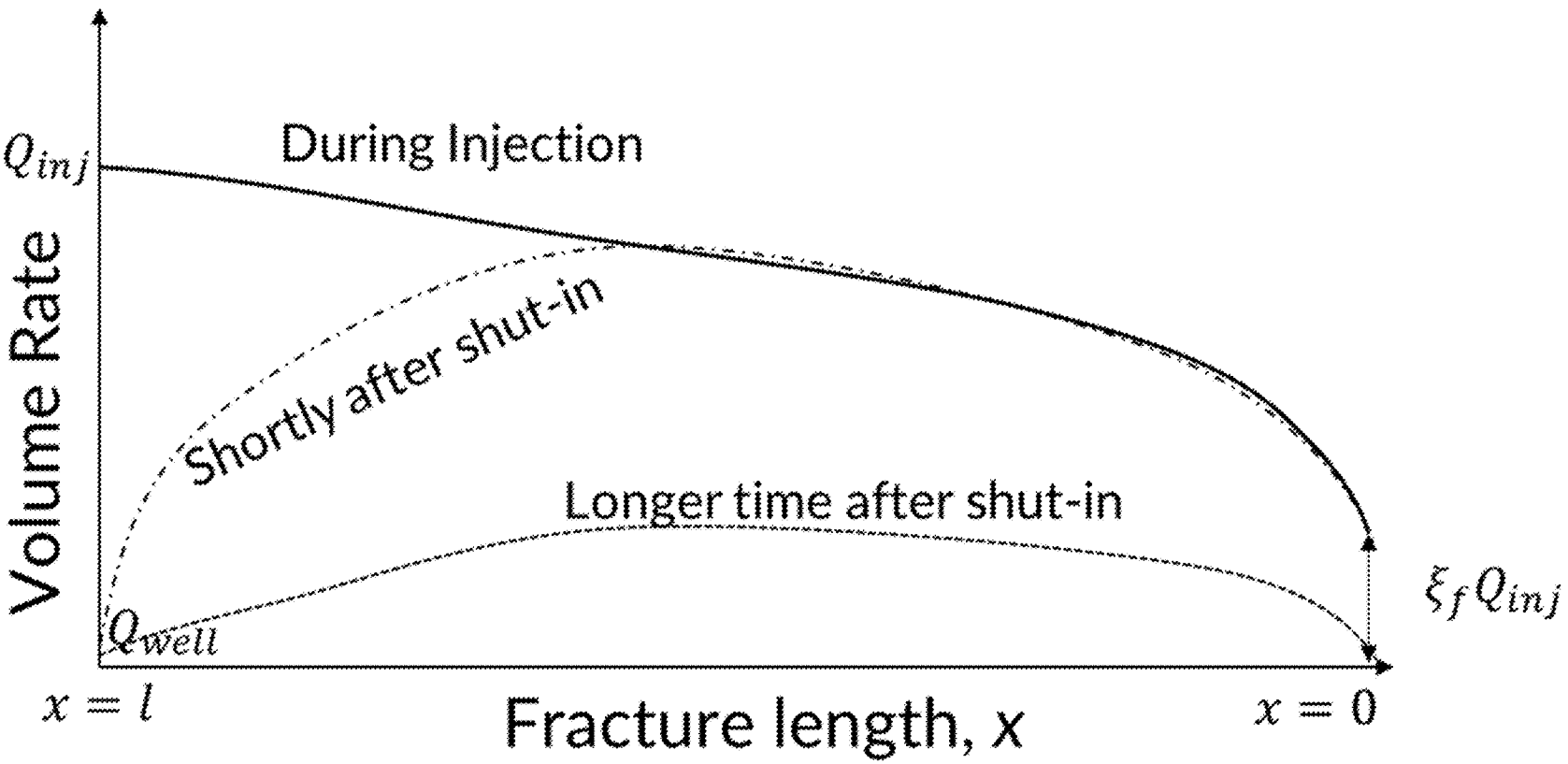
FIG. 14 shows evolution of volumetric flowrate at 3 different times, during injection, shortly after shut-in and longer time after shut-in. as a function of fracture position (x).

Finally, in order to calculate the required time for moving this volume one needs to know the volume rate. This volume rate initially is equal to $q_{inj}$. However, as pressure equilibrated in the fracture this volume rate decreases. FIG. 14 depicts the relationship between volume rate and fracture length at different times (e.g., during, shortly after and at longer times after injection) respectively. Assuming $q=q_{inj}$, calculate the lower bound to determine the time that needed for equilibration as:

$$t_{equil}^{min} = \frac{V^*}{q_{inj}} = 0.08t_{inj} \tag{87}$$

This is the minimum required time for equilibration without taking into account leak-off; the actual equilibration time will be much longer. The same calculation may be performed for the case with the leak-off. Assume a very simple constant fluid leak-off from the fracture to formation, the equation for such case will be:

$$t_{equil}^{min} = \frac{0.08}{0.4 + 0.6\eta_{av}}t_{inj} \tag{88}$$

The minimum required time for equilibration thus depends on the injection time and at least 8 percent of injection time (see Eq. 87) is needed for equilibration. Usually the injection time is approximately 2 hours. Thus, the minimum required time is 8% of two hours, or about 10 minutes, and the actual required time will be much longer. Therefore, the effect of the pressure equilibration cannot be neglected and it should be considered in the formulation. Formulating this pressure equilibration is difficult since it depends on several unknown properties such as: fluid rheology, fracture permeability, fluid degradation due to temperature and shear, among other properties. Even with these parameters the analysis will be numerical as there is no analytical solution for the volume rate post-shut-in. Therefore, for the sake of the completeness of the model, some reasonable assumptions may be made to derive a relatively simple equation for the pressure equilibration. Assuming flow rate between the two parts (FIG. 13) depends linearly on the pressure difference between the average pressure of these two parts, then by using this assumption an equation for the time may be written as:

$$p_M(t) = p_{ave}(t) + \frac{1-\beta_s}{\beta_s}\overline{p_n}^0\exp(-c_{eq}t) \tag{89}$$

where the last term in the right hand side of Eq. 89 represents the difference between the average pressure and the fracture mouth pressure. As it can be seen, this pressure difference is maximum at the shut-in time and decreases with time. $c_{eq}$ is the unknown parameter that determines how fast this equilibration happens. Assuming at the end of Segment 2 that the pressure in the fracture is almost uniform, then, one can set $c_{eq}=4$ at the time t=t* (end of Segment 2) which means just 2% of the initial pressure difference has remained at the end of segment 2.

Near-Wellbore Pressure Loss

Figure 15:
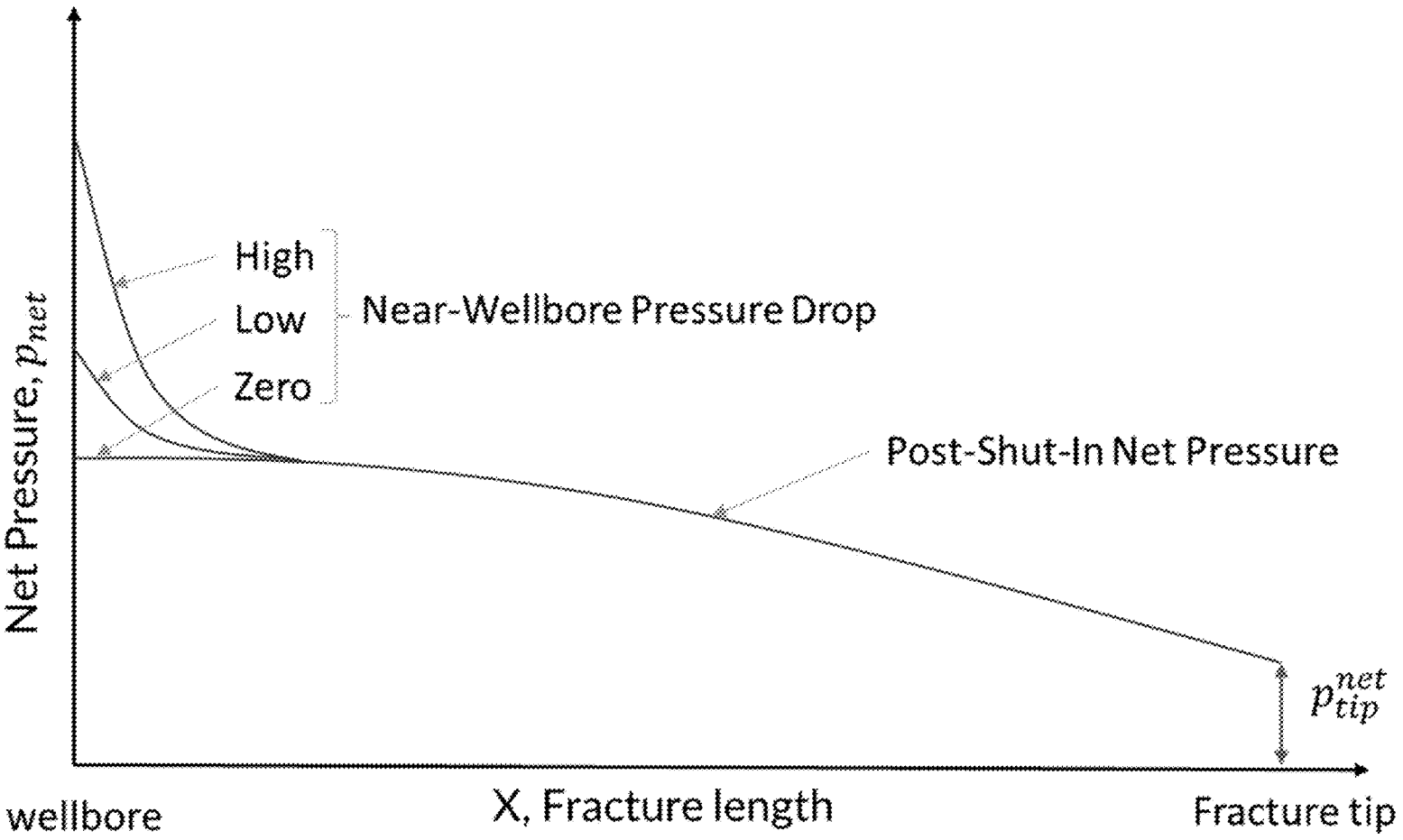
FIG. 15 shows possible pressure profile with large or small NWB pressure drop (see, Weijers et al., 1994, Weijers et al. 2000).
Figure 16:
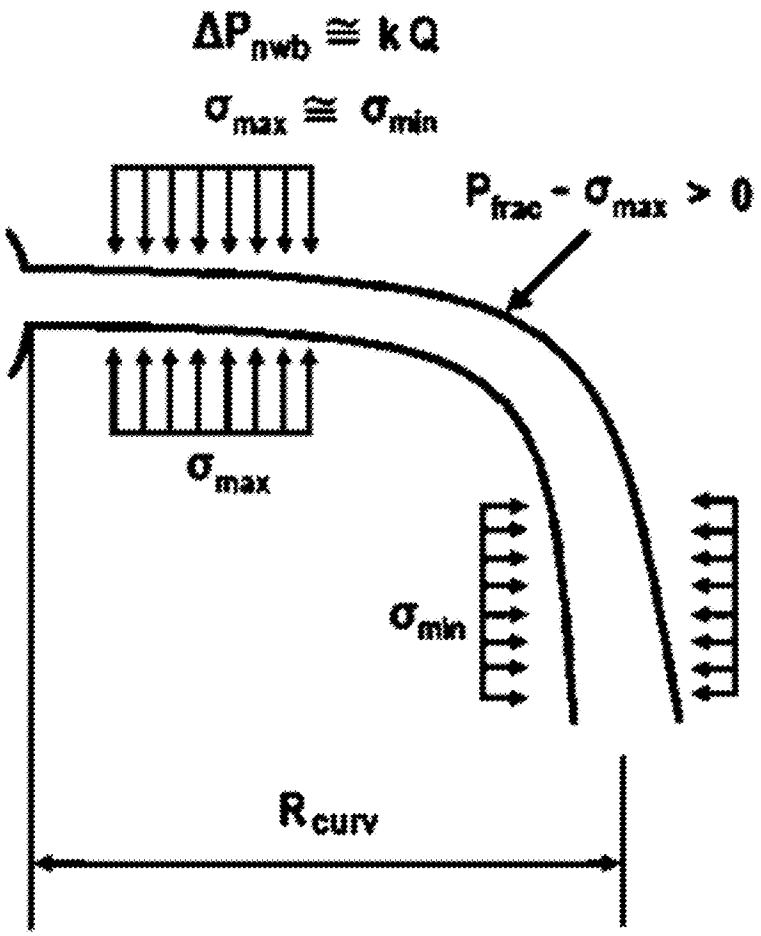
FIG. 16 shows two extreme conditions for the near wellbore width and permeability dependence on pressure (see, Weijers et al. 2004, Weng et al. 1993).
Figure 16:
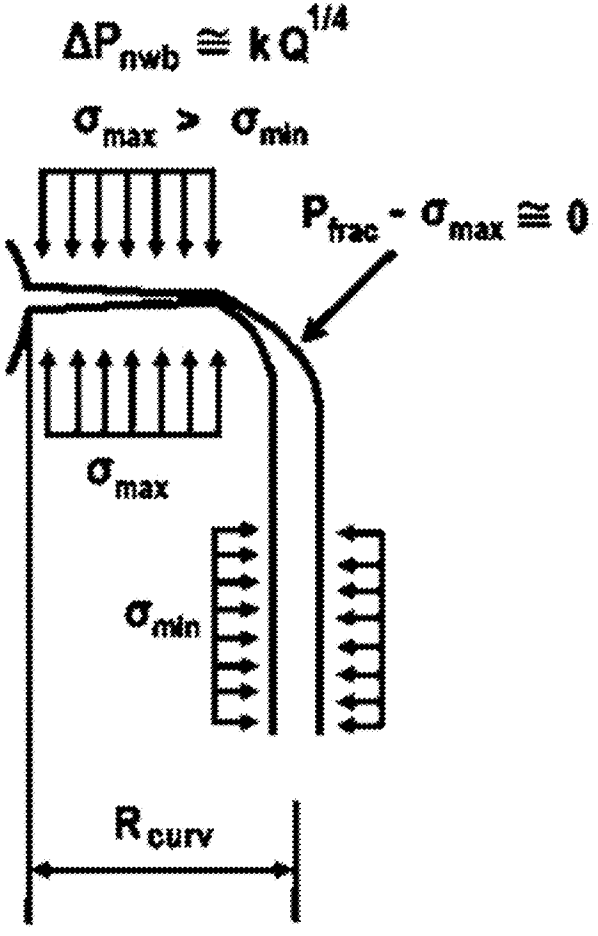

The final pressure loss to consider is the pressure loss in the NWB (FIG. 2, 201) region. This pressure loss causes fast decay of pressure in the near-wellbore region. FIG. 15 illustrates possible pressure profiles for cases with large, small, and zero NWB pressure loss. The NWB pressure loss can be calculated as:

$$p_{NWBPL}=\alpha_{NWB}q_{NWB}^{\beta_{NWB}} \tag{90}$$

where $\alpha_{NWB}$ is a parameter that will be discussed further below, $\beta_{NWB}$=unknown exponent which depends on the properties of NWB region, $q_{NWB}$ is the flow rate from the NWB region to the FF region. Focusing on calculation of the flow rate:

$$q_{NWB}=\frac{k_{NWB}A_{NWB}}{\mu_{NWB}}\frac{\partial p}{\partial x} \tag{91}$$

where kNWB=NWB permeability, ANWB=NWB area, μNWB=viscosity of the fluid in NWB. Calculation of this flow rate is very complicated since the shape of the NWB is very complex and it is difficult to calculate the pressure profile in this region. Also, it is unclear how the permeability and the area of the NWB depend on the pressure. Based on the literature, there are two extreme conditions for the dependence of the area and permeability on pressure in the NWB region. The first extreme condition is having constant permeability and area (kNWBANWB∝pNWB0), the second extreme is having completely pressure-dependent width and permeability. In the second extreme condition the relationship is cubic kNWBANWB∝pNWB3. The value of βNWB also depends on the dependence of the permeability and width to pressure. Weijers et al. (2004) hypothesized that the exponent βNWB should be constrained between 0.25 and 1. The lower bound of 0.25 was derived from flow in a fracture whose width depends on the fluid pressure in the fracture (Perkins and Kern 1961). The upper bound of 1 was based on flow between parallel plates of fixed width. FIG. 16 illustrates these two extreme conditions.

Usually in literature, an average condition is assumed for this pressure dependence and $\beta_{NWB}$=0.5 is used. For this exponent, $k_{NWB}A_{NWB}\propto p_{NWB}^2$. If $\beta_{NWB}$=0.5 and instead of pressure gradient using the average pressure gradient between the wellbore region and the FF region gives:

$$q_{NWB}=q_{NWB}^0\frac{p_{NWB}^2}{(p_{NWB}^0)^2}\frac{p_w-p_M}{p_w^0-p_M^0} \tag{92}$$

where $q^0_{NWB}$ is the initial value of flow rate at the shut-in time which is almost equal to injection flow rate $q^0_{NWB}\approx q_{inj}$. $p_{NWB}$ is the average net pressure in the near-wellbore zone and can be calculated as:

$$p_{NWB}=\frac{p_w+p_M}{2}-\sigma_{NWB} \tag{93}$$

where $\sigma_{NWB}$ is the average pressure that NWB opens against which can be calculated as:

$$\sigma_{NWB}=\frac{\sigma_{max}+\sigma_{min}}{2} \tag{94}$$

where $\sigma_{max}$=maximum horizontal stress and $\sigma_{min}$=min horizontal stress. The value of the $\sigma_{max}$ can be estimated by the pressure at which the first segment finishes (in the time domain, the time point between segments 301 and 302 in FIG. 3, at about 700 seconds) is a good estimate of the maximum horizontal stress. This is due to the fact that when the pressure drops below the maximum horizontal stress pressure (maximum horizontal stress, $\sigma_{max}$), the fracture grows mainly in the preferred direction which is normal to $\sigma_{min}$. Thus, the pressure at the end of segment 1 should be a good estimate of the pressure above which fractures in a direction other than the preferred direction can exist. Therefore, this pressure can be a rough estimate of the maximum horizontal stress.

The value of $p_{NWBPL}$ can be calculated as:

$$p_{NWBPL}=a_{NWB}\left(q_{NWB}^0\frac{p_{NWB}^2}{(p_{NWB}^0)^2}\frac{p_w-p_M}{p_w^0-p_M^0}\right)^{\beta_{NWB}} \tag{95}$$

The only unknown is the value of the $\alpha_{NWB}$. This value can be calculated by using the pressure difference between $p_w$ and $p_M$ in one point post-shut-in. Knowing the value of the $p_{NWBPL}$ results in:

$$p_w=p_M+p_{NWBPL} \tag{96}$$

Figure 17:
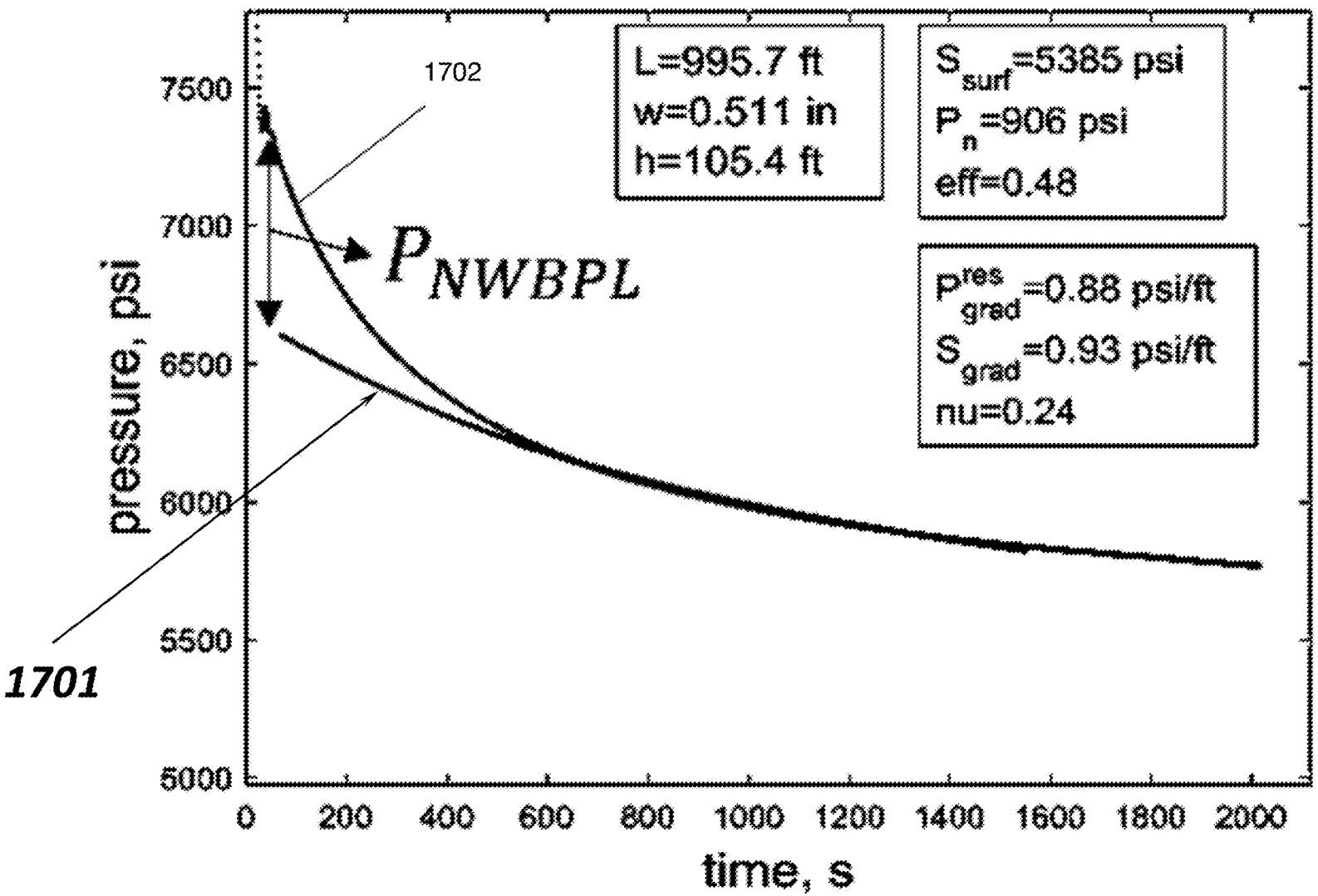
FIG. 17 shows the $p_{NWBPL}$ effect.

In order to calculate the value of $\alpha_{NWB}$ the pressure difference between the wellbore pressure and the mouth pressure at the mid-point of segment 1 is used. An example is in FIG. 17, where curve 1701 shows the pressure decay without taking into account the NWB pressure drop; curve 1702 includes the NWB pressure drop.

Relationship Between Reservoir Pressure and Minimum Principal Stress

Figure 18:
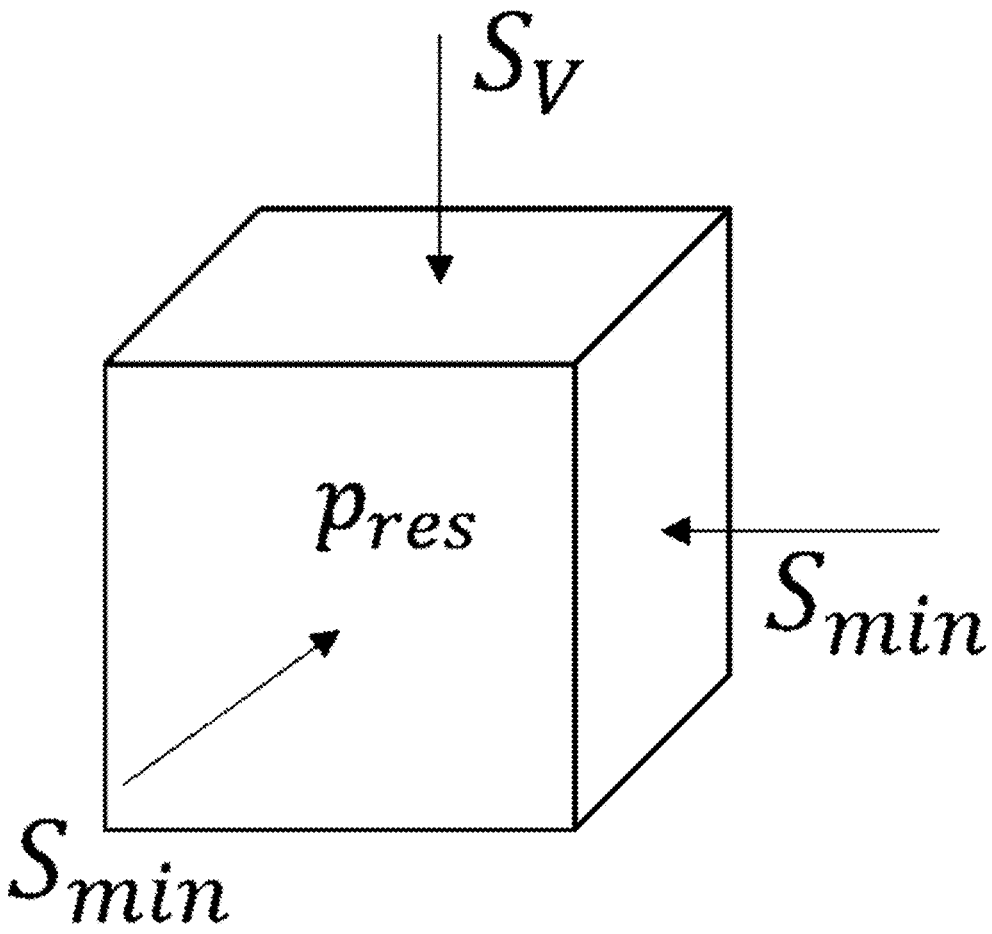
FIG. 18 shows the stress state of a rock in formation (see, Economides and Nolte, 1983).

Theoretical relationships between formation fluid (pore) pressures and stresses have been used to constrain horizontal least stress (fracture gradients) for a long time. The "classical" lateral constraint model assumes that the effective horizontal stress can be computed from the vertical stress when in a fully relaxed geologic basin by assuming the earth can be modeled as if it is vertically loaded by gravity instantaneously under uniaxial strain conditions, which means, as in the case of a rock mechanics lab test, there is no lateral strain ($\varepsilon_{xx}=\varepsilon_{yy}=0$). Assuming a Biot coefficient (a rock property, typically in the range of 0.6-0.8) approximately equal to 1 and equal horizontal stresses ($S_{min}=S_{xx}=S_{yy}$), referring to FIG. 18:

$$\epsilon_{yy}=\epsilon_{xx}=\frac{S_{\min}-p_{res}}{E}-\frac{\nu}{E}(S_V-p_{res}+S_{min}-p_{res})=0 \tag{97}$$

where v=Poisson ratio, E=Young's modulus, $S_V$=Vertical stress, $S_{min}$=Minimum principal stress. Using Eq. 97, gives:

$$S_{min}=\frac{\nu}{1-\nu}S_V+\frac{1-2\nu}{1-\nu}p_{res} \tag{98}$$

Equation (98) has been derived assuming a fully relaxed basin. However due to the tectonic pressures, equation may be modified as follows:

$$S_{min} = \frac{\nu}{1-\nu} S_V + \frac{1-2\nu}{1-\nu} p_{res} + S_T \tag{99}$$

where $S_T$ is the tectonic stress. The value of the tectonic stress is unknown and may be calculated based on the pressure values of stage 1 of a well, the very first stage to be hydraulically stimulated. Also, vertical stress is usually between 1-1.2 psi/ft. In the present disclosure, $S_V$=1.1 psi/ft is used. Eq. 99 can be used to relate the change of minimum stress to the change of reservoir pressure and Poisson ratio. Generally, any change in $S_{min}$ can be either explained by the change in Poisson ratio, change in reservoir pressure, or the change in both of these parameters. Since experiments show that the value of the Poisson ratio varies in the formation, it is reasonable to attribute the principal cause for the change in $S_{min}$ is to the change in the Poisson ratio. However, experiments usually show as well the value of the Poisson ratio does not change more than a few percent over a few of hundred feet distance, corresponding to a typical stage length between hydraulic fracturing "stages" separated by impermeable "bridge" plugs in the well during stage pumping. It is therefore consistent with observations to set an empirical limit on such change, for example, 10%.

Figure 19:
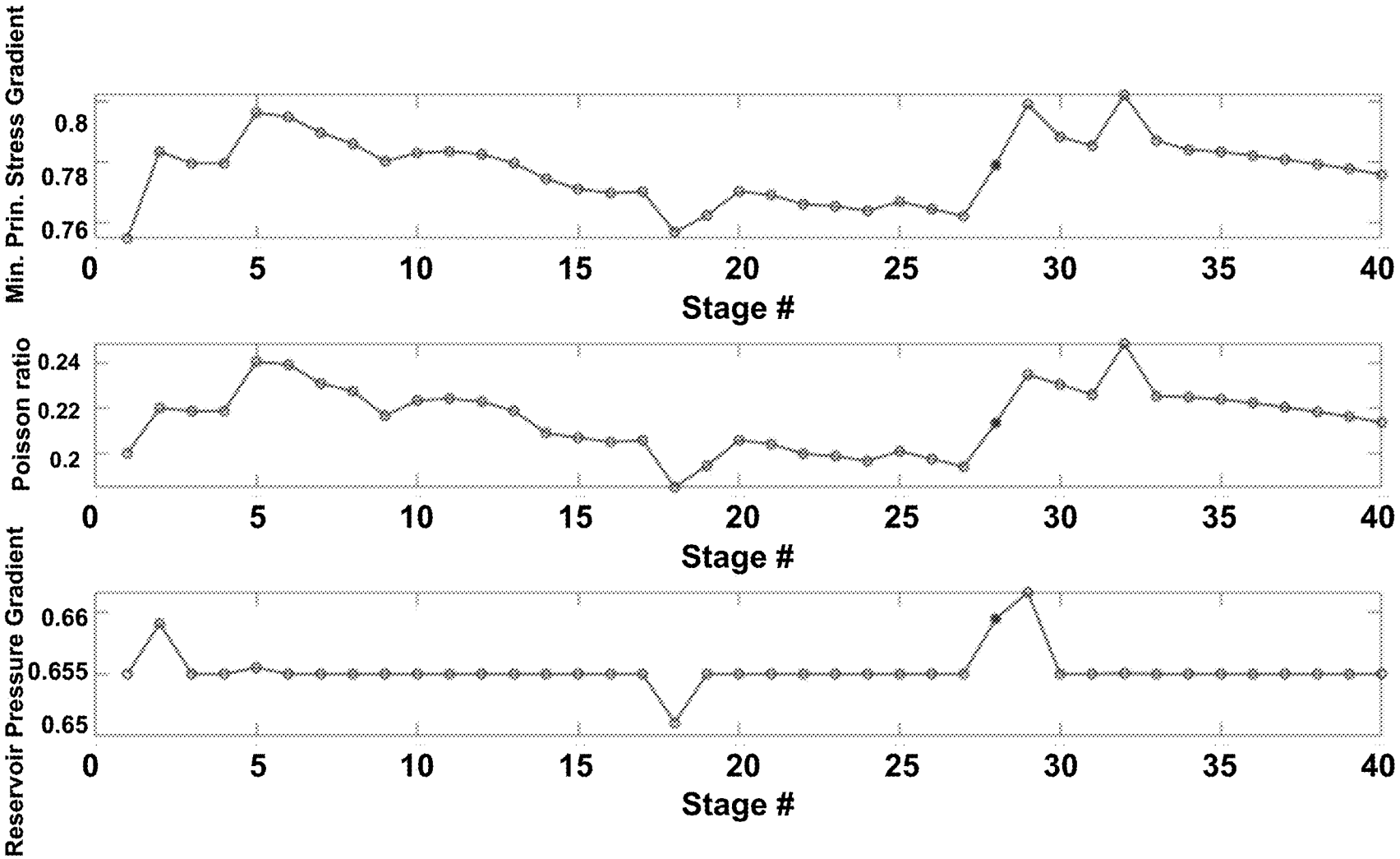
FIG. 19 shows a relationship between minimum stress, reservoir pressure and the Poisson ratio.

As a result, any further change of $S_{min}$ may be attributed to the change in reservoir pore fluid pressure. Finally, the initial value of reservoir pore pressure (stage 1) is needed to use this method. Such value can be guessed, estimated, or calculated from the pumping information in the first pumped fracture stage (stage 1). FIG. 19 shows an example of results using Eq. 99 to explain the change in $S_{min}$. As it can be seen, the change of the $S_{min}$ between stages from one stage to another can usually be explained by 10% change in the Poisson ratio other than for a couple of the stages that needed either more change in Poisson ratio or the change in reservoir pressure. Therefore, since the variation of the Poisson ratio is limited to 10%, the extra change of $S_{min}$ was attributed to the change in $p_{res}$. There may be other methods or models to vary both reservoir pressure and Poisson ratio in a more realistic way, but the approach disclosed here is simple and effective.

Calculating Fracture Dimensions

To calculate actual fracture dimensions, one can assume a fracture shape similar to those used in a PKN model, for example, as described in U.S. Patent Application Publication No. 2020/0319007 filed by Moos et al.:

$$V_{fr} = \frac{\pi}{4(n+1)} w_f H_f L_f \tag{100}$$

where $w_f$, $L_f$, and $H_f$ are the values of width, length and height of the fracture at the end of a pumping stage. Also, n is the shape factor to consider the effect of decrease of width in a PKN fracture. For normal values of $p_{tip}$, n is approximately 0.1. The effect on n is negligible in the determined final dimensions (<1%). Based on the Sneddon relationship, $w_f$ can be calculated as:

$$w_f = \frac{2H_f}{E'} p_n^0 \tag{101}$$

Next, using the definition of average efficiency:

$$\eta_{av} V_{inj} = V_{fr} = \frac{\pi}{2(n+1)} \frac{p_n^0}{E'} H_f^2 L_f \tag{102}$$

and using Eq. 41 yields:

$$\frac{L_f}{H_f^4} = (p_M^4 - p_{tip}^4) \frac{\pi}{32E'^3 \mu_{ap} q_{inj} \left(\xi_f + \frac{2}{\pi}(1-\xi_f)\right)} \tag{103}$$

Pressure Dependent Leak-off

Pressure-dependent leak-off (PDL) is a type of leak-off in which, fracturing fluid can penetrate to the surrounding matrix, pre-existing natural fractures and fissures. During the increase of the treating pressure along the main fracture, the dilation of natural fractures and fissures can be induced and thus significantly increase the leak-off. To further improve results, PDL is included in the model.

The pressure at which the natural fractures start to dilate is called reactivation pressure, $p_{act}$. If the well fluid pressure is above this pressure, a higher leak-off may be expected. Thus, the simplest formula can be as follows:

$$C_{leak} = C_{form} + (C_{leak}^0 - C_{form}) \frac{p - p_{act}}{p^0 - p_{act}} \tag{104}$$

where $C_{leak}$ is the pressure dependent leak-off coefficient; $C_{form}$ is the intrinsic leak-off coefficient associated with the formation; $C_{leak}{}^0$ is the leak-off coefficient at $p=p^0$ and $p^0$ is the initial pressure in the fracture at the time of shut-in.

There are two new unknowns in PDL relation, $p_{act}$ and $C_{form}$. To calculate these parameters we used the pressure derivative in segment 3 (leak-off only segment). If no PDL is present, segment 3 should have a constant slope. However, usually, this segment has a decreasing slope with time, which shows PDL is present and the variation of this slope is used to calculate the unknown parameters in PDL relation.

Providing Additional Constraints on NWB Pressure Drop from NWB Acoustic Measurements The present part of the disclosure addresses the observation that NWB pressure loss (NWBPL) is due to flow through a finite region with a low permeability. The relationship between pressure loss and flow rate is as described in Eq. 108 and for all fractures in Eq. 109.

To further improve results, an additional constraint can be placed on pressure decay analysis using active acoustic pulsing. Such pulsing method is described in Dunham 2017, where conductivity of hydraulic fractures is estimated from analysis of tube wave reflections. Use of the resulting hydraulic fracture conductivity measurement is described below.

Figure 20:
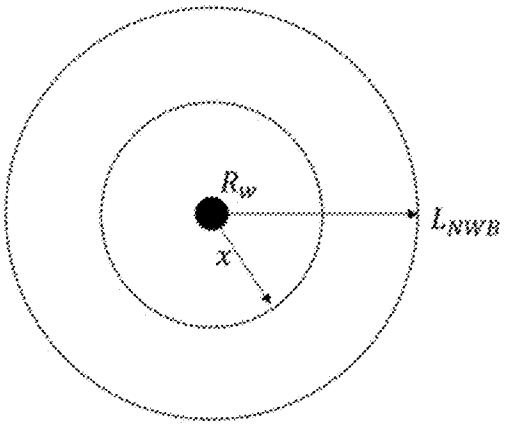
FIG. 20 graphically shows NWB Pressure Drop and schematically, NWB cylindrical cross-section.
Figure 20:
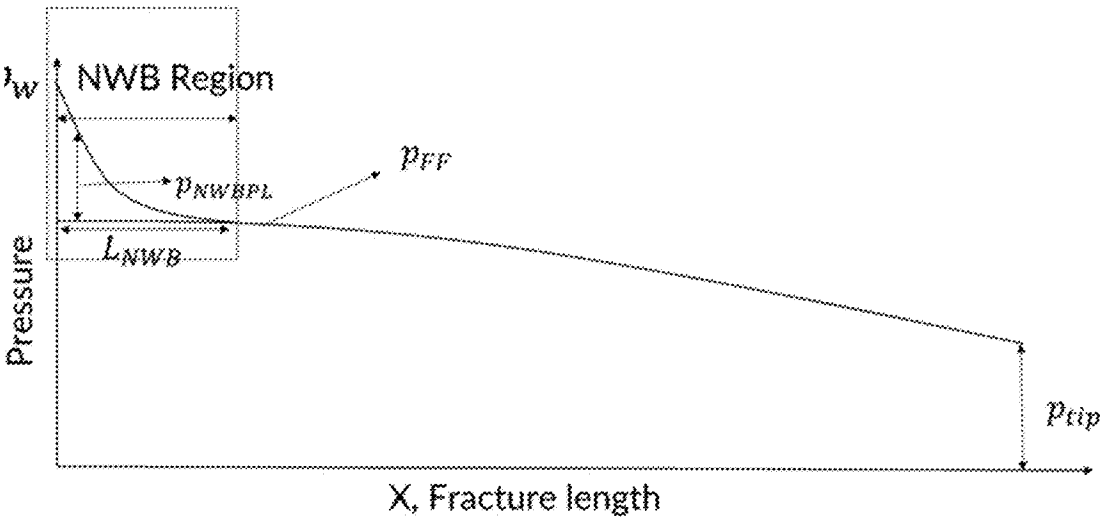

A defined near-field connectivity index (NFCI) exists (see Eq. 107, which can be determined using, for example, the method disclosed in U.S. Pat. No. 10,641,090 issued to Felkl et al.). The NFCI is a measure of the hydraulic conductivity in the near-wellbore (NWB) region. Thus NFCI can be used to estimate the pressure drop in the NWB region. FIG. 20 shows NWB Pressure Drop and NWB cylindrical cross-section. It should be mentioned that the NWB region pressure loss ($p_{NWBPL}$) is an important part of the initial pressure drop (right after shut-in) and determining the value of NWB pressure loss can help to better determine the other sources of the pressure drop (see FIG. 20 panel A). To calculate the NWB pressure loss, start with the flow equation (Darcy law) in the NWB region of a bi-wing fracture:

$$q_{NWB} = \frac{k_{NWB} A_{NWB}}{\mu} \frac{dp}{dx} \tag{105}$$

where $k_{NWB}$ is the permeability of the NWB region, and $A_{NWB}$ is the cross section of the NWB region. For simplicity, it may be assumed the NWB region is axisymmetric and then use an idealized cylindrical growth of cross-section, see FIG. 20, panel B. Thus, $A_{NWB}=2\pi x w_{NWB}$. Also, note that the total flow in all fractures of one fracture treatment stage can be calculated as $$Q_{NWB} = N_{frac} q_{NWB} = 2\pi \frac{N_{frac} k_{NWB} w_{NWB}}{\mu} x \frac{dp}{dx} \tag{106}$$

where $N_{frac}$ is the number of fractures in one stage. NFCI is defined as $$NFCI = \frac{N_{frac} k_{NWB} w_{NWB}}{\mu} \tag{107}$$

Thus, using the NFCI definition, the flow in the NWB region can be calculated as $$Q_{NWB} = 2\pi NFCI\, x \frac{dp}{dx} \tag{108}$$

During the fluid injection period, $Q_{NWB}$ is almost constant within the whole NWB region. Thus, by integrating the flow relation to calculate the initial NWB pressure loss, $p_{NWBPL}^0$ $$p_{NWBPL}^0 = Q_{inj} \frac{\mathrm{Ln}\left(\frac{L_{NWB}}{R}\right)}{2\pi NFCI} \tag{109}$$

Figure 21:
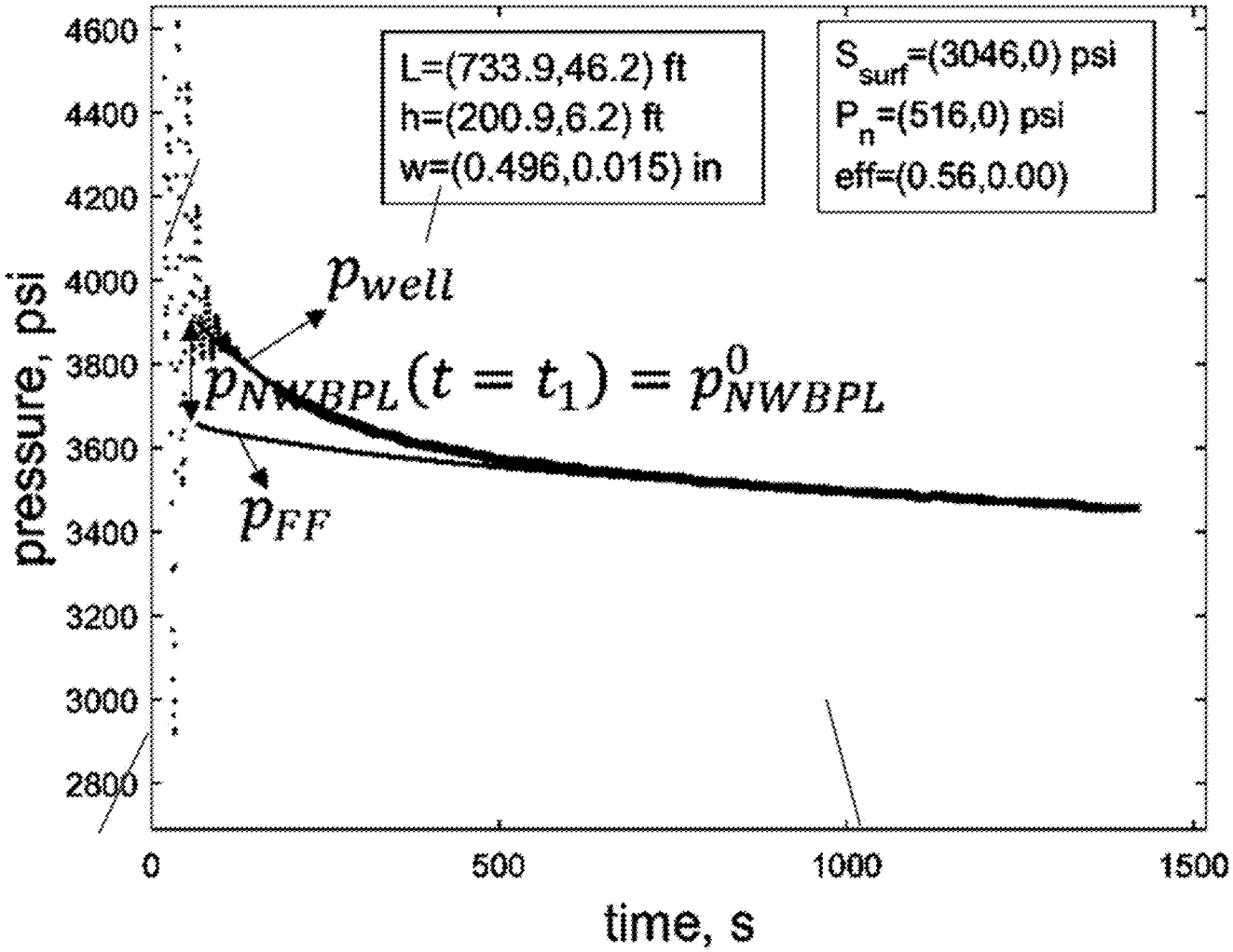
FIG. 21 shows a graph of a post shut-in pressure decay curve.

Note that this relationship gives the initial value of the NWB pressure loss (synonym with pressure drop); pressure in the NWB region will continue dropping post shut-in and as a result $p_{NWBPL}$ is not constant (see FIG. 21). Also, since the only time we know the flow rate is just prior to shut-in, the flow rate right prior to shut-in, $Q_{inj}$, is used to calculate the initial NWB pressure drop. A typical post shut-in pressure decay curve is shown in FIG. 21.

Figure 22:
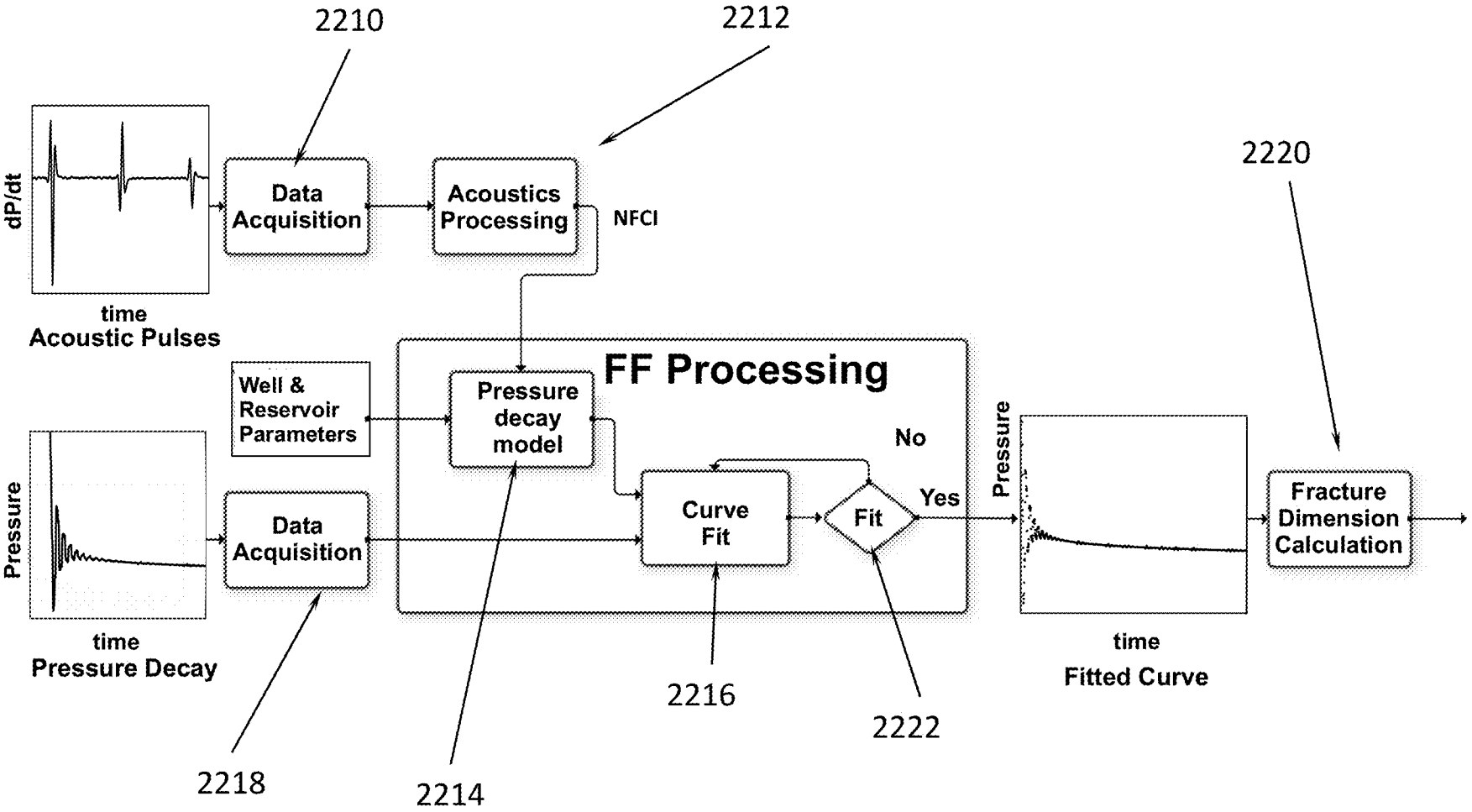
FIG. 22 shows a block diagram of using acoustic measurements and pressure decay measurements after shut-in to estimate fracture dimensions.

Having a correct value for NWB pressure drop helps the model to better separate the pressure drop due to different sources and thus have a more accurate calculation of fracture dimensions and efficiency. FIG. 22 illustrates the integrated NF-FF model, in which the NFCI values calculated using least misfit inversions are used in the 3-Segment FF model to calculate the fracture dimensions and efficiency. At 2210, acoustic pulses are emitted into the well to induce tube waves in the well and in the connected fractures; and pressure or pressure time derivative are measured in response to the emitted acoustic pulses. At 2212, the detected pressure or pressure time derivative measurements are processed to obtain the NCFI. The NFCI may be used, at 2214 in connection with well pressure measurements made over time, shown at 2218, to constrain the 3-segment model as explained herein. At 2216, the pressure decay measurements are curve fit to a modeled pressure decay curve based on the three segment model. At 2222, if the curve fit is not within a predetermined error or misfit, the parameters for the 3 segment model are adjusted and a new model curve is generated. Returning to 2216, the measured pressure decay is compared to the modeled pressure decay. If the curve fit is within the predetermined error or misfit, at 2220, fracture dimensions are calculated using the model parameters from the most recent iteration of the 3 segment model.

Developing Proxies to Determine the Productivity Potential of Each Stage and Wellbore In this section will be developed proxies to determine the fluid production potential of each stage in a well and all staged within the entire well. The first proxy is called well potential, $\Gamma_{well}$, and its value per stage is called stage well potential, $\Gamma_{stage}$, and can be calculated as:

$$\Gamma_{stage}=1-\eta_{ave} \tag{110}$$

where $\eta_{ave}$=the average efficiency of each stage (calculated by fitting the pressure decay curve). $\Gamma_{stage}$ can be a good proxy to determine how easy it will be to produce oil or gas from each stage since it shows how easy it is to lose fluid at each stage. In the other words, if within a stage the reservoir formation has a large conductivity, which causes low efficiency, it may be expected that the large conductivity of the formation will enable a large fluid production rate as well. In order to calculate the well potential, the weighted average of stage well potential $\Gamma_{stage}$ values as:

$$\Gamma_{well} = \frac{\Sigma\left(\Gamma_{stage}^{i} L_i H_i N_i^{cluster}\right)}{\Sigma\left(L_i H_i N_i^{cluster}\right)} \tag{111}$$

where $N_i^{cluster}$=number of perforation clusters in stage i, $L_i$=the stage fracture length, $H_i$=stage fracture height. $\Gamma_{well}$ should be a rough proxy to determine the productivity of the entire well. Specially, $\Gamma_{well}$ can be used to compare the productivity of adjacent wells.

Although, the well potential is an easy proxy to measure, it has the drawback that it can depend significantly on the pumping design. Specially, it can depend significantly on the injection rate during fracture pumping. This results from the fact that when the injection rate is low, the injected fluid has more time to leak-off and thus the efficiency will be lower, than may be the case at higher injection rates. However, this low efficiency (thus high well potential) is not due to higher permeability of the reservoir formation but is just due to the low injection rate. Thus, well potential is a good proxy to compare the production of wells with similar treatment pumping designs. To solve this issue, define reservoir potential $\Theta_{Res}$, the value of which per stage is called stage reservoir potential, $\Theta_{stage}$. To calculate $\Theta_{stage}$, start by calculating the Carter leak-off coefficient using Eq. 3 as:

$$c_{leak} = \frac{(1-\xi)q_{inj}\sqrt{t_{eq}}}{A_{fs}} \tag{112}$$

where $A_{fs}$=fracture surface area, $\xi$=fracture growth ratio (local efficiency), $q_{inj}$=injection rate, and $t_{eq}$=equivalent leak-off time. The equation to calculate the Carter leak-off coefficient can be further simplified and written as:

$$c_{leak} = \frac{1}{2}\frac{1-\xi}{\eta_{ave}}\frac{\overline{w}}{\sqrt{2t_{inj}}} \tag{113}$$

where $\overline{w}$=average width of fracture, and $t_{inj}$=injection time. Carter leak-off coefficient can be calculated using the reservoir properties as (Carter, 1957):

$$c_{leak} = \sqrt{\frac{k_r c_r \phi}{\pi \mu_r}}\,\Delta p_{dr} \tag{114}$$

where $k_r$=reservoir formation permeability, $c_r$=reservoir total compressibility, $\phi$=reservoir porosity (fractional volume of pore space in the reservoir rock), $\mu_r$=reservoir fluid viscosity, and $\Delta p_{dr}$=the leak-off driving force of leak-off and can be calculated as:

$$\Delta p_{dr} = S_{min} + p_n - p_{res} \tag{115}$$

where $S_{min}$=minimum horizontal stress, $p_n$=net pressure, and $p_{res}$=reservoir pore pressure. As Eq. 115 shows, the $$\frac{c_{leak}}{\Delta p_{dr}}$$

should be a good proxy to determine the mobility $$\left(\frac{k_r}{\mu_r}\right)$$

of the reservoir and thus the stage reservoir potential can be defined as:

$$\Theta_{stage} = \frac{c_{leak}}{\Delta p_{dr}} \tag{116}$$

Since $\Theta_{stage}$ solely depends on the conductivity of the formation, it is a good proxy to determine the potential production of reservoir at each stage. Furthermore, similar to well potential, we can calculate the reservoir potential by taking the weighted average of $\Theta_{stage}$ values as:

$$\Theta_{well} = \frac{\Sigma\left(\Theta^{i}_{stage} L_i H_i N_i^{cluster}\right)}{\Sigma\left(L_i H_i N_i^{cluster}\right)} \tag{117}$$

Implementing the Disclosed Procedure of 3 Segment Pressure Decay

Figure 9:
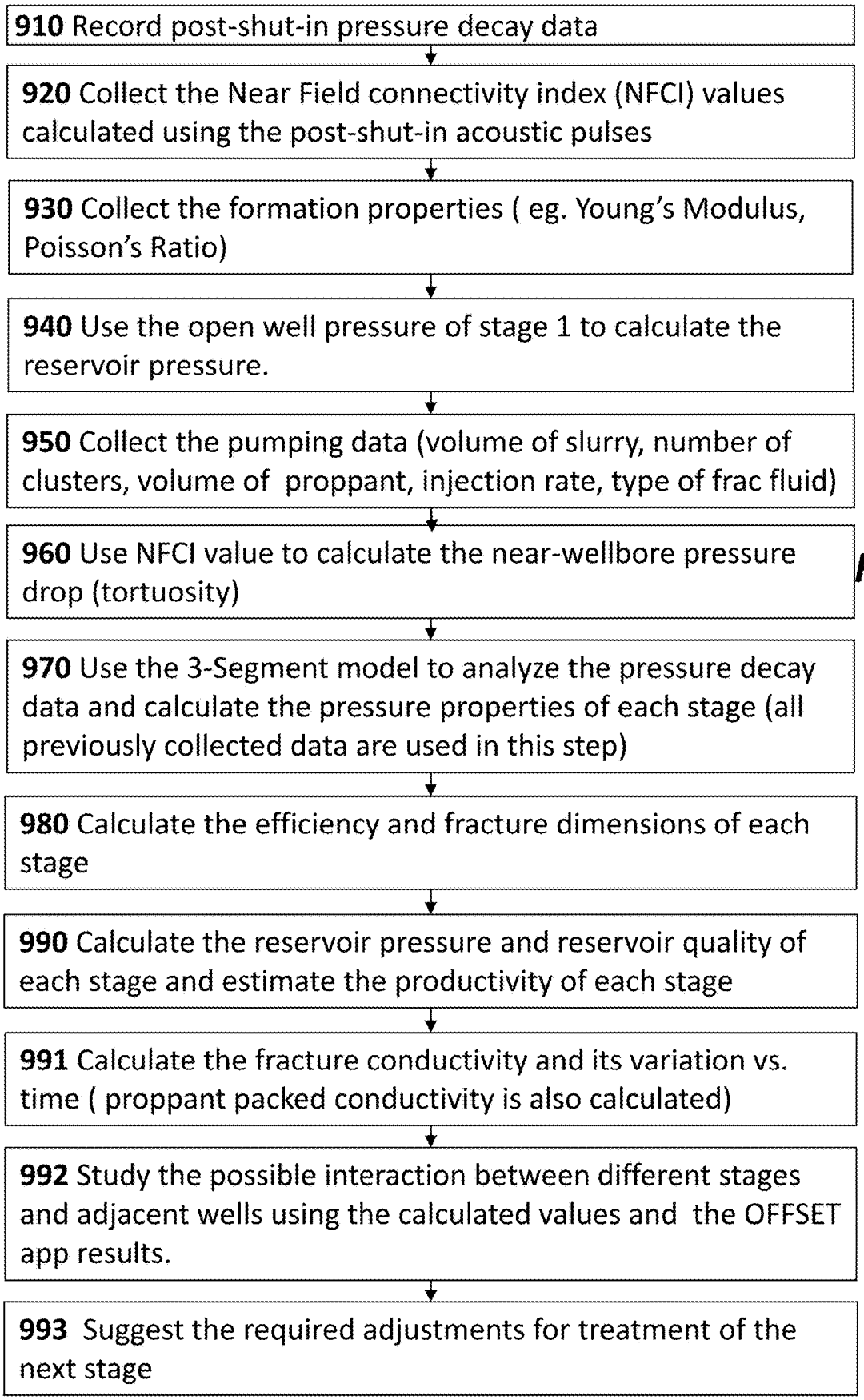
FIG. 9 shows a flowchart of the process of implementing a 3-segment model to obtain fracture properties; It also shows the (optional) process of implementing a 3-segment model to obtain fracture properties using acoustically measured constraint (NFCI) to calculate NWB pressure drop.

FIG. 9 is a flow chart of an example implementation of a method according to the present disclosure. FIG. 9 shows an example workflow where in some embodiments, the NFCI determination from pulsed acoustic measurement is used to estimate or constrain the NWB pressure drop, and thereby to improve the estimate of fracture dimensions. Using acoustic-pulse-determined NFCI is an option and may be omitted in some embodiments.

At 910, pressure at the well in which fracture treatment is being pumped is measured. Pressure is recorded after pumping stops and the well is shut in. The pressure measured at the well may be expected to decrease with respect to time after shut in. Typically at least 10 minutes of pressure measurements after shut in should be recorded.

At 920 the fracture conductivity may be calculated using analysis of post-shut-in acoustic pulses emitted in the well and the response of pressure or pressure time derivative to such pulses. Conductivity is defined as permeability times fracture width. A method for making and analyzing acoustic pulse measurements as disclosed in U.S. Pat. No. 10,641,090 issued to Felkl et al. can be used to provide such calculation. This step is optional if one would like to perform only pressure decay analysis using the presented 3-segment approach.

At 930, reservoir rock formation properties may be obtained. The formation properties may be known for a particular geology and geographic location from logs, seismic surveys, and other geologic survey sources.

At 940, use the open well pressure of the first pumped fracture state (stage 1) to calculate the reservoir pressure. Open well pressure refers to the pressure in the wellbore after an initial pressure test and before the start of injection of fracture fluid in the first stage, when the wellbore is effectively "open", i.e., it is not being externally pressurized, and the pressure in the well is indicative of the reservoir pressure to which it is connected at the bottom of the well. The open well pressure in stage 1 may be used as a proxy for the reservoir pressure. The 3-segment model may be used later in the process to verify the reservoir pressure value and if necessary modify it. In horizontal fracture treatment, i.e., multiple stages along a horizontal well, just the value of stage 1 prior to hydraulic fracturing treatment can be used. For vertical well fracturing, the reservoir pressure may be different at each treatment stage; therefore the open well pressure of each stage may be used.

At 950, fracture treatment pumping data are measured and recorded. Pumping data such as volume of slurry, number of clusters, volume of proppant, injection rate, type of fracture fluid liquid phase, among others, is collected for input to the model used in the present method.

At 960, which is an optional for the 3 segment pressure decay determination, the acoustic NFCI measurements made at 920 can be used to calculate near wellbore pressure drop to provide a more accurate determination of fracture properties.

At 970, the 3-segment model as described above (Eqs. 22-103) may be used to analyze the pressure decay data and calculate the pressure properties of each stage (all previously collected data may be used in this element of the method).

At 980, the efficiency and fracture dimensions for each fracture stage are calculated Refer to Eqs. 101-103 for fracture geometry calculations, and Eqs. 1-21 for efficiency calculations.

At 990, the reservoir pressure and reservoir quality of each stage are calculated and an estimate the productivity of each stage may be made.

At 991 the fracture conductivity is calculated as well as its variation with respect to time (the "proppant packed conductivity" is also calculated). This is distinguishable from 920, wherein the calculation of the fracture conductivity is of the near-wellbore region (NWB, shown at 202 in FIG. 2). At 910, the conductivity is calculated for the far-field region, FF (203 in FIG. 2). Due to leak-off, the fracture loses fluid and its volume decreases after shut in. At 990, the conductivity is determined as a function of time. As time passes (post-shut-in) the conductivity of fracture in the FF region decreases. When fracture is hydraulically closed, and its volume is maintained only by proppant in the fracture, the fracture volume stops decreasing and the fracture conductivity at such time is named "proppant packed conductivity."

At 992, evaluate possible interaction between different fracture treatment stages and adjacent wells using the calculated values of NFCI, stress shadowing, and any measured offset-well interactions. Offset well interactions require simultaneous pressure measurements made in at least 2 nearby wells). See, for example, International Application Publication No. WO 2021/087233 filed by Moos et al. That publication describes interaction between wells from stress shadow effects to direct fracture-fracture interactions, crossing, or merging.

At 993, required adjustments for treatment of a subsequent fracture stage may be determined. This can be done based on determined fracture geometry to maximize the stimulated reservoir region or any other parameter thereto determined that can be used to inform fracturing treatment designs. The well operator may want to leave as little unstimulated reservoir between nearby wells as possible without having the fracture systems of nearby overlap and cannibalize production from each other. Several factors may be considered in evaluating changes to expected fracture geometry in subsequent stages: 1) The spacing between the wells and the parts of the formation which remained intact. 2) Based on the height of fracture and comparing it to the thickness of the formation 3) Based on the stress shadowing effect between the stages and 4) based on the possible interaction between the adjacent wells. Leak-off parameter can be used to estimate productivity. Higher leakoff parameter means a more productive formation (i.e. easier to extract hydrocarbons from).

It will be appreciated that method according to the present disclosure may be performed on any general purpose or specific purpose computer or computer system. Such computers or computer systems may comprise a reader to access information stored on a non-transitory computer readable medium such as magnetic disk or solid state memory. Such computer readable medium may comprise logic operable to cause the computer or computer system to execute actions corresponding to the methods as described in this disclosure. Such computer system may be disposed, for example and without limitation, in the data processing apparatus shown at 103 in FIG. 1A.

Although only a few examples have been described in detail above, those skilled in the art will readily appreciate that many modifications are possible in the examples. Accordingly, all such modifications are intended to be included within the scope of this disclosure as defined in the following claims.

REFERENCES CITED IN THIS DISCLOSURE

Kun Ai, Longchen Duan, Hui Gao, and Guangliang Jia. Hydraulic fracturing treatment optimization for low permeability reservoirs based on unified fracture design. *Energies,* 11(7): 1720, 2018.

Julius Bankong Arop. *Geomechanical review of hydraulic fracturing technology*. PhD thesis, Massachusetts Institute of Technology, 2013.

Mohammed Salem Ba Geri. *Investigating the performance of high viscosity friction reducers used for proppant transport during hydraulic fracturing.* 2019

Bin Chen, Song Cen, Andrew R Barron, D R J Owen, and Chenfeng Li. Numerical investigation of the fluid lag during hydraulic fracturing. *Engineering Computations,* 2018.

Dong Chen, Zhihui Ye, Zhejun Pan, Yingfang Zhou, and Jialiang Zhang. A permeability model for the hydraulic fracture filled with proppant packs under combined effect of compaction and embedment. *Journal of Petroleum Science and Engineering,* 149:428-435, 2017.

M P Cleary, D E Johnson, H H Kogsboll, K A Owens, K F Perry, C J De Pater, Alfred Stachel, Holger Schmidt, Tambini Mauro, et al. Field implementation of proppant slugs to avoid premature screen-out of hydraulic fractures with adequate proppant concentration. *In Low permeability reservoirs symposium*. Society of Petroleum Engineers, 1993.

Michael J Economides, Kenneth G Nolte, et al. Reservoir stimulation, volume 2. Prentice Hall Englewood Cliffs, N J, 1989.

Jiahang Han, John Yilin Wang, and Virendra Puri. A fully coupled geomechanics and fluid flow model for proppant pack failure and fracture conductivity damage analysis. *Journal of Natural Gas Science and Engineering,* 31:546-554, 2016.

Y Thomas Hu, David Fisher, Pious Kurian, Ron Calaway, et al. Proppant transport by a high viscosity friction reducer. In *SPE Hydraulic Fracturing Technology Conference and Exhibition*. Society of Petroleum Engineers, 2018.

R G Jeffrey et al. The combined effect of fluid lag and fracture toughness on hydraulic fracture propagation. In *Low Permeability Reservoirs Symposium*. Society of Petroleum Engineers, 1989.

Y Kovalyshen and E Detournay. A reexamination of the classical PKN model of hydraulic fracture. *Transport in porous media,* 81(2):317-339, 2010.

Brice Lecampion, Jean Desroches, Xiaowei Weng, Jerey Burghardt, J Ernest Brown, et al. Can we engineer better multistage horizontal completions? evidence of the importance of near-wellbore fracture geometry from theory, lab and eld experiments. In *SPE Hydraulic Fracturing Technology Conference*. Society of Petroleum Engineers, 2015.

Carl Montgomery et al. Fracturing Fluids. In ISRM International Conference for Effective and Sustainable Hydraulic Fracturing. *International Society for Rock Mechanics and Rock Engineering,* 2013.

Luiz Bortolan Neto, Aditya Khanna, and Andrei Kotousov. Conductivity and performance of hydraulic fractures partially filled with compressible proppant packs. *International Journal of Rock Mechanics and Mining Sciences,* 74:1-9, 2015.

Geoffrey A Roberts, Simon T Chipperfield, William K Miller, et al. The evolution of a high near-wellbore pressure loss treatment strategy for the Australian cooper basin. In *SPE Annual Technical Conference and Exhibition*. Society of Petroleum Engineers, 2000.

Mohammad Vahab and Nasser Khalili. Computational algorithm for the anticipation of the fluid-lag zone in hydraulic fracturing treatments. *International Journal of Geomechanics,* 18(10):04018139, 2001.

Peter Valko and Michael J Economides. *Hydraulic fracture mechanics*, volume 28. Wiley Chichester, 1995.

Jiehao Wang and Derek Elsworth. Role of proppant distribution on the evolution of hydraulic fracture conductivity. Journal of Petroleum Science and Engineering, 166:249-262, 2018.

L Weijers, CA Wright, H Sugiyama, K Sato, L Zhigang, et al. Simultaneous propagation of multiple hydraulic fractures-evidence, impact and modeling implications. In *International Oil and Gas Conference and Exhibition in China*. Society of Petroleum Engineers, 2000.

Leendert Weijers, C J De Pater, K A Owens, H H Kogsboll, et al. Geometry of hydraulic fractures induced from horizontal wellbores. *SPE Production & Facilities,* 9(02): 87-92, 1994.

Xiaowei Weng et al. Fracture initiation and propagation from deviated wellbores. In *SPE annual technical conference and exhibition*. Society of Petroleum Engineers, 1993.

C A Wright, W A Minner, L Weijers, E J Davis, G M Golich, H Kikuchi, et al. Wellbore-to-fracture communication problems pose challenges in California diatomite horizontal wells. In *SPE Annual Technical Conference and Exhibition*. Society of Petroleum Engineers, 1997.

Shuang Zhang, Hewei Tang, Robert Hurt, Vikram Jayaram, Jed Wagner, et al. Joint interpretation of fiber optics and downhole gauge data for near wellbore region characterization. In *SPE Hydraulic Fracturing Technology Conference and Exhibition*. Society of Petroleum Engineers, 2020.

Perkins, T. K., and L. R. Kern. "Widths of Hydraulic Fractures." *J Pet Technol* 13 (1961): 937-949. doi: https://doi.org/10.211.8189-PA.

Nordgren, R. P. "Propagation of a Vertical Hydraulic Fracture." *SPE J.* 12 (1972): 306-314. doi: https://doi.org/10.2118/3009-PA Carter R. D. 1957 Derivation of the general equation for estimating the extent of the fractured area. Appendix to "Optimum fluid characteristics for fracture extension" by G. C. Howard and C. R. Fast, Drill. and Prod. Prac. API, 261-270.

SNEDDON, I. N., & ELLIOTT, H. A. (1946). THE OPENING OF A GRIFFITH CRACK UNDER INTERNAL PRESSURE. *Quarterly of Applied Mathematics,* 4(3), 262-267. http://www.jstor.org/stable/43633558

Eric M. Dunham et al. Hydraulic fracture conductivity inferred from tube wave reflections. Paper presented at the 2017 *SEG International Exposition and Annual Meeting*, Houston, Texas, September 2017. Paper Number: SEG-2017-17664595

What is claimed is:

1. A method for determining properties of hydraulic fractures from measurements of pressure in a well made after stopping pumping fracturing fluid into the well (shut in), comprising:

determining a first time after shut in where after a decrease in measured pressure is caused by fluid leak off in a fracture;

determining a second time after shut in where after the decrease in pressure is caused by fluid leak off, fracture growth and fluid pressure equilibration in the fracture;

determining a third time after shut in where after the decrease in pressure is caused by fluid leak off, fracture growth, fluid pressure equilibration in the fracture and pressure drop in a near wellbore zone; and determining values of fluid efficiency, minimum stress and net pressure which result in a calculated pressure with respect to time matching the pressure measurements within a predetermined threshold, wherein calculating pressure with respect to time is based on causes of pressure drop in segments corresponding to time between (i) the third time and the second time, (ii) the second time and the first time, and (iii) after the first time.

2. The method of claim 1 wherein the calculated pressure beginning at the first time comprises calculating Carter leak off.

3. The method of claim 1 wherein the calculated pressure beginning at the second time and ending at the third time comprises calculating $$p_{av} = S_{min} + p^* + \left(\overline{p_n}^0 - p^*\right)\sqrt{\frac{1-\xi_f}{\xi_f}}\, tg\left[\arctan\left(\sqrt{\frac{\xi_f}{1-\xi_f}}\right) - \frac{t}{t_{inj}}\frac{\overline{p_n}^0}{\overline{p_n}^0 - p^*}\frac{\sqrt{\xi_f(1-\xi_f)}}{\eta_{av}}\right]$$

in which $\xi_f$=Local efficiency or fracture growth ratio at shut-in, $\eta_{av}$=Average efficiency from start of fluid pumping to shut in, $p_{av}$=average net pressure in the fracture, p*=fracture propagation pressure, $\overline{p}_n$=average net pressure, $p_n^0$=initial net pressure $t_{inj}$=injection time, t=time for which pressure calculation is made, and Smin—minimum principal stress.

4. The method of claim 1 wherein the calculated pressure beginning at the third time and ending at the second time comprises calculating a near wellbore pressure drop from Darcy equation flow for an axisymmetric, bi-wing fracture having cylindrical cross-sectional growth.

5. The method of claim 1 wherein the calculated pressure beginning at the third time and ending at the second time comprises analyzing reflection events in measurements of pressure or pressure time derivative in response to acoustic pulses emitted into the well, the acoustic pulses inducing tube waves in the well to determine a near field conductivity index to constrain calculation of near wellbore pressure drop.

6. The method of claim 1 wherein the third time is determined after an end of water hammer induced by the stopping pumping.

7. The method of claim 1 wherein the second time is determined when a rate of change of the measurements of pressure with respect to time falls below a predetermined threshold.

8. The method of claim 1 wherein the first time is determined when the measurements of pressure fall below a fracturing pressure of a rock formation into which the fracturing fluid is pumped.

9. The method of claim 1 further comprising estimating a fluid pressure in a formation penetrated by the fracture using the determined minimum stress.

10. The method of claim 1 wherein the efficiency comprises a fraction of a volume of the fracture with respect to a volume of fracturing fluid pumped into the fracture.

11. The method of claim 1 further comprising changing at least one of viscosity of the fracturing fluid, pumped volume of the fracturing fluid, a volume rate of pumping the fracturing fluid, or a concentration of proppant in the fracturing fluid for pumping fracture fluid into a different stage in the well or in a different well.

12. The method of claim 1 further comprising determining fracture conductivity with respect to time after shut in.

13. The method of claim 12 further comprising determining a proppant packed conductivity when the fracture conductivity stops changing with respect to time after shut in.

14. The method of claim 1 further comprising:

using the determined values of fluid efficiency, minimum stress and net pressure; and using values of Young's modulus, Poisson's ratio, viscosity of the fracturing fluid, pumped volume of the fracturing fluid, a volume rate of pumping the fracturing fluid, a number of well perforation clusters through which the fracturing fluid is pumped, determining a length, a width, a height and a leak off parameter of the fracture.

15. The method of claim 14 wherein the determining length, width and height of the fracture comprises using a Perkins-Kern-Nordgren model of geometry of the fracture.

16. The method of claim 14 wherein the determined fracture length, fracture width, fracture height and the leak-off parameters are used to estimate a fluid productivity of each fracture treatment stage and the entire well.

17. A computer program stored in a computer readable medium, the program comprising logic operable to cause a programmable computer to perform actions on measurements of pressure made in a well after stopping pumping (shut in) a fracture treatment into the well, the actions, comprising:

determining a first time after shut in where after a decrease in measured pressure is caused by fluid leak off in a fracture;

determining a second time after shut in where after the decrease in pressure is caused by fluid leak off, fracture growth and fluid pressure equilibration in the fracture;

determining a third time after shut in where after the decrease in pressure is caused by fluid leak off, fracture growth, fluid pressure equilibration in the fracture and pressure drop in a near wellbore zone; and determining values of fluid efficiency, minimum stress and net pressure which result in a calculated pressure with respect to time matching the pressure measurements within a predetermined threshold, wherein calculating pressure with respect to time is based on causes of pressure drop in segments corresponding to time between (i) the third time and the second time, (ii) the second time and the first time, and (iii) after the first time.

18. The computer program of claim 17 wherein the calculated pressure beginning at the first time comprises calculating Carter leak off.

19. The computer program of claim 17 wherein the calculated pressure beginning at the second time and ending at the third time comprises calculating $$p_{av} = S_{min} + p^* + (\overline{p_n}^0 - p^*)\sqrt{\frac{1-\xi_f}{\xi_f}}\, tg\left[\arctan\left(\sqrt{\frac{\xi_f}{1-\xi_f}}\right) - \frac{t}{t_{inj}}\frac{\overline{p_n}^0}{\overline{p_n}^0 - p^*}\frac{\sqrt{\xi_f(1-\xi_f)}}{\eta_{av}}\right]$$

in which $\xi_f$=Local efficiency or fracture growth ratio at shut-in, $\eta_{av}$=Average efficiency from start of fluid pumping to shut in, $p_{av}$=average net pressure in the fracture, p*=fracture propagation pressure, $\overline{p}_n$=average net pressure, $p_n^0$=initial net pressure $t_{inj}$=injection time, t=time for which pressure calculation is made, and Smin—minimum principal stress.

20. The computer program of claim 17 wherein the calculated pressure beginning at the third time and ending at the second time comprises calculating a near wellbore pressure drop from Darcy equation flow for an axisymmetric, bi-wing fracture having cylindrical cross-sectional growth.

21. The computer program of claim 17 wherein the calculated pressure beginning at the third time and ending at the second time comprises analyzing reflection events in measurements of pressure or pressure time derivative in response to acoustic pulses emitted into the well, the acoustic pulses inducing tube waves in the well to determine a near field conductivity index to constrain calculation of near wellbore pressure drop.

22. The computer program of claim 17 wherein the third time is determined after an end of water hammer induced by the stopping pumping.

23. The computer program of claim 17 wherein the second time is determined when a rate of change of the measurements of pressure with respect to time falls below a predetermined threshold.

24. The computer program of claim 17 wherein the first time is determined when the measurements of pressure fall below a fracturing pressure of a rock formation into which the fracturing fluid is pumped.

25. The computer program of claim 17 further comprising instructions operable to cause the computer to perform estimating a fluid pressure in a formation penetrated by the fracture using the determined minimum stress.

26. The computer program of claim 17 wherein the efficiency comprises a fraction of a volume of the fracture with respect to a volume of fracturing fluid pumped into the fracture.

27. The computer program of claim 17 further comprising logic operable to cause the computer to perform changing at least one of viscosity of the fracturing fluid, pumped volume of the fracturing fluid, a volume rate of pumping the fracturing fluid, or a concentration of proppant in the fracturing fluid for pumping fracture fluid into a different stage in the well or in a different well.

28. The computer program of claim 17 further comprising instructions operable to cause the computer to perform determining fracture conductivity with respect to time after shut in.

29. The computer program of claim 28 further comprising determining a proppant packed conductivity when the fracture conductivity stops changing with respect to time after shut in.

30. The computer program of claim 17 wherein the logic further comprises logic operable to cause the computer to perform the acts of:

using the determined values of fluid efficiency, minimum stress and net pressure; and using values of Young's modulus, Poisson's ratio, viscosity of the fracturing fluid, pumped volume of the fracturing fluid, a volume rate of pumping the fracturing fluid, a number of well perforation clusters through which the fracturing fluid is pumped, determining a length, a width, a height and a leak off parameter of the fracture.

31. The computer program of claim 30 wherein the determining length, width and height of the fracture comprises using a Perkins-Kern-Nordgren model of geometry of the fracture.

32. The computer program of claim 30 wherein the determined fracture length, fracture width, fracture height and the leak-off parameters are used to estimate a fluid productivity of each fracture treatment stage and the entire well.

* * * * *